US009579917B2

(12) United States Patent
Yahata et al.

(10) Patent No.: US 9,579,917 B2
(45) Date of Patent: Feb. 28, 2017

(54) ERASING APPARATUS AND IMAGE FORMING APPARATUS THAT USES THE ERASING APPARATUS

(71) Applicants: KABUSHIKI KAISHA TOSHIBA, Tokyo (JP); TOSHIBA TEC KABUSHIKI KAISHA, Tokyo (JP)

(72) Inventors: Isao Yahata, Izunokuni Shizuoka (JP); Ken Iguchi, Numazu Shizuoka (JP); Naofumi Soga, Sunto Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/942,699

(22) Filed: Nov. 16, 2015

(65) Prior Publication Data

US 2016/0136987 A1 May 19, 2016

(30) Foreign Application Priority Data

Nov. 17, 2014 (JP) ..... 2014-233163
Nov. 17, 2014 (JP) ..... 2014-233164

(51) Int. Cl.
*B41M 7/00* (2006.01)

(52) U.S. Cl.
CPC ..... *B41M 7/0009* (2013.01)

(58) Field of Classification Search
CPC ..... B41M 7/0009
See application file for complete search history.

(56) References Cited

U.S. PATENT DOCUMENTS

| | | | | |
|---|---|---|---|---|
| 9,126,786 | B2 * | 9/2015 | Taki | B65H 7/20 |
| 2010/0092202 | A1 * | 4/2010 | Ishio | G03G 15/5066 399/80 |
| 2011/0222951 | A1 * | 9/2011 | Yahata | B41J 2/32 400/645.2 |
| 2012/0025454 | A1 | 2/2012 | Iguchi et al. | |
| 2012/0026531 | A1 * | 2/2012 | Iguchi | B65H 5/26 358/1.14 |
| 2012/0147398 | A1 * | 6/2012 | Iguchi | B41J 2/32 358/1.9 |
| 2013/0001050 | A1 * | 1/2013 | Oshiro | G03G 21/00 198/780 |

FOREIGN PATENT DOCUMENTS

JP 2007034127 A * 2/2007

* cited by examiner

*Primary Examiner* — Bradley Thies
(74) *Attorney, Agent, or Firm* — Patterson & Sheridan, LLP

(57) ABSTRACT

In one embodiment, an erasing apparatus stores a first feeder unit and an erasing device. A casing of the erasing apparatus supports the first sheet stack and the erasing device slidably in a direction perpendicular to a direction of supplying a sheet from the first sheet stack to the erasing device. The first sheet stack and the erasing device are movable into and out of the casing.

15 Claims, 21 Drawing Sheets

ERASING APPARATUS AND IMAGE FORMING APPARATUS THAT USES THE ERASING APPARATUS

CROSS-REFERENCE TO RELATED APPLICATIONS

This application is based upon and claims the benefit of priority from the prior Japanese Patent Application No. 2014-233163, filed on Nov. 17, 2014, the entire contents of which are incorporated herein by reference.

This application is also based upon and claims the benefit of priority from the prior Japanese Patent Application No. 2014-233164, filed on Nov. 17, 2014, the entire contents of which are incorporated herein by reference.

FIELD

The embodiments described below generally relate to an erasing apparatus and an image forming apparatus that uses the erasing apparatus.

BACKGROUND

In the past, as an image forming apparatus, there are known apparatuses, e.g., MFPs (Multi-Function Peripherals), having a plurality of functions such as printing functions for printing images on sheets and reading functions for reading documents by using scanners.

The image forming apparatus includes a printer device for the printing function, a scanner device for the reading function, and the like. The printer device, the scanner device, and the like are stored in a main casing.

Further, the image forming apparatus includes a feeder unit that supplies sheets to the printer device. Examples of the feeder unit includes a regular feeder unit that supplies sheets stored in the paper cassette to the printer device, and a large-volume feeder unit capable of storing sheets more than the sheets stored in the regular feeder unit. The regular feeder unit and the large-volume feeder unit are stored in the dedicated casings independent of the main casing.

Depending on the type of usage, the dedicated casing of the feeder unit is connected to the main casing, and the feeder unit functions as a feeder of the image forming apparatus.

For example, the dedicated casing of the regular feeder unit is connected to the lower portion of the main casing. Further, the dedicated casing of the large-volume feeder unit is connected to the dedicated casing of the regular feeder unit of the lower portion.

Alternatively, in place of the dedicated casing of the regular feeder unit, the dedicated casing of the large-volume feeder unit is connected to the lower portion of the main casing.

Further, examples of the image forming apparatus having the plurality of functions include an apparatus having an erasing function. According to the erasing function, the apparatus heats an image printed on a sheet with an erasable toner or the like at a predetermined erasing temperature, for example, and thereby erases the image in order to reuse the sheet on which the image is printed.

The image forming apparatus having the erasing function includes an erasing unit for realizing the erasing function.

The erasing unit is also stored in a dedicated casing independent of the main casing.

The erasing unit is not capable of supplying an erased sheet to the printer device individually.

Because of this, even if the dedicated casing of the erasing unit is connected to the main casing of the image forming apparatus in place of the dedicated casing of the feeder unit, the erasing unit is not capable of supplying the sheet to the printer device.

So, according to a conventional image forming apparatus, even if the erasing unit is used, it is not possible to diversify means for supplying sheets to the printer device.

According to a conventional image forming apparatus, the dedicated casing of the erasing unit is connected to, for example, the lower portion of the dedicated casing of the feeder unit in order that the erasing unit may supply erased sheets to the feeder unit.

According to an another idea, the feeder unit including the paper cassettes and the like and the erasing unit may be embedded in one dedicated casing to thereby integrate the feeder unit and the erasing unit. However, if both the units are integrated, it is necessary to consider how to maintain the units when setting sheets in the paper cassette, when clearing a paper jam of the erasing unit, and the like.

DETAILED DESCRIPTION

Figure 1:
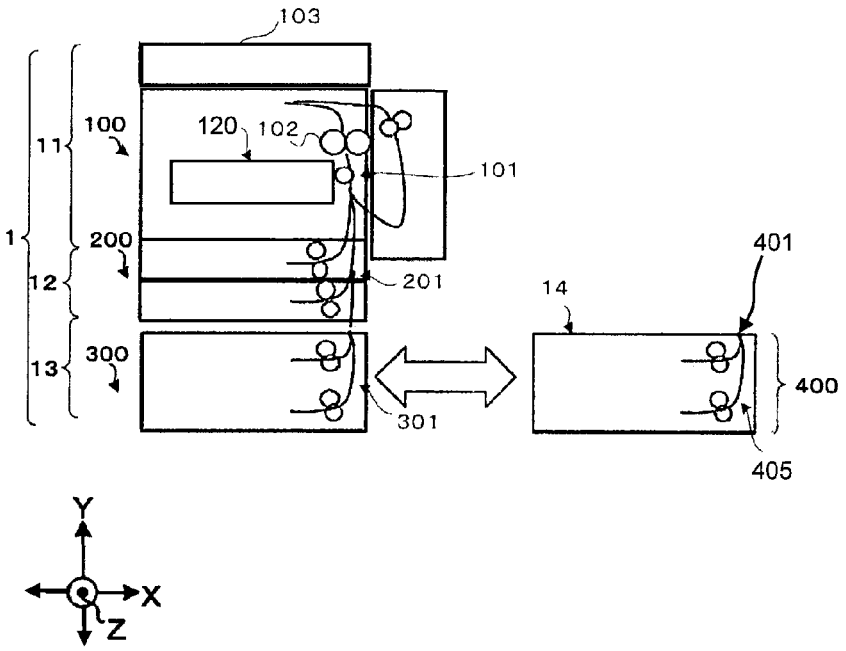
FIG. 1 is a front sectional view schematically showing an image forming apparatus according to the first embodiment.

According to one embodiment, an erasing apparatus includes a first sheet stack, an erasing device, and a casing.

The first sheet stack stores an unerased sheet.

The erasing device erases an image from an unerased sheet, the unerased sheet being supplied from the first sheet stack.

The casing of the erasing apparatus stores the first sheet stack and the erasing device. The casing of the erasing apparatus further supports the first sheet stack and the erasing device slidably in a direction perpendicular to a direction of supplying a sheet from the first sheet stack to the erasing device, the first sheet stack and the erasing device being movable into and out of the casing.

According to one embodiment, an image forming apparatus includes an image forming apparatus main body, a first feeder unit, and an erasing unit.

The image forming apparatus main body includes a printer device, a first casing, and a first conveying path.

The printer device forms an image on a sheet.

The first casing stores the printer device.

The first conveying path in the first casing conveys a sheet to the printer device.

The first feeder unit includes a storage unit, a second casing, and a second conveying path.

The storage unit stores a sheet on which no image is formed.

The second casing stores the storage unit, the second casing being connected with the first casing.

The second conveying path in the second casing is connected with the first conveying path when the second casing is connected with the first casing, the second conveying path supplying the sheet to the first conveying path.

The erasing unit includes a first sheet stack, an erasing device, a third casing, and a third conveying path.

The first sheet stack stores an unerased sheet on which an image is formed.

The erasing device erases the image formed on the unerased sheet.

The third casing stores the first sheet stack and the erasing device, the third casing being connected with the second casing.

The third conveying path in the third casing is connected with the second conveying path when the third casing is connected with the second casing. The third conveying path further supplies an erased sheet from which an image is erased by the erasing device to the first conveying path via the second conveying path.

Hereinafter, embodiments will further be described with reference to the drawings. In the drawings, the same reference symbols show the same of similar parts.

First Embodiment

Hereinafter, a first embodiment will be described.

FIG. 1 is a front view schematically showing an image forming apparatus according to the first embodiment.

Figure 2:
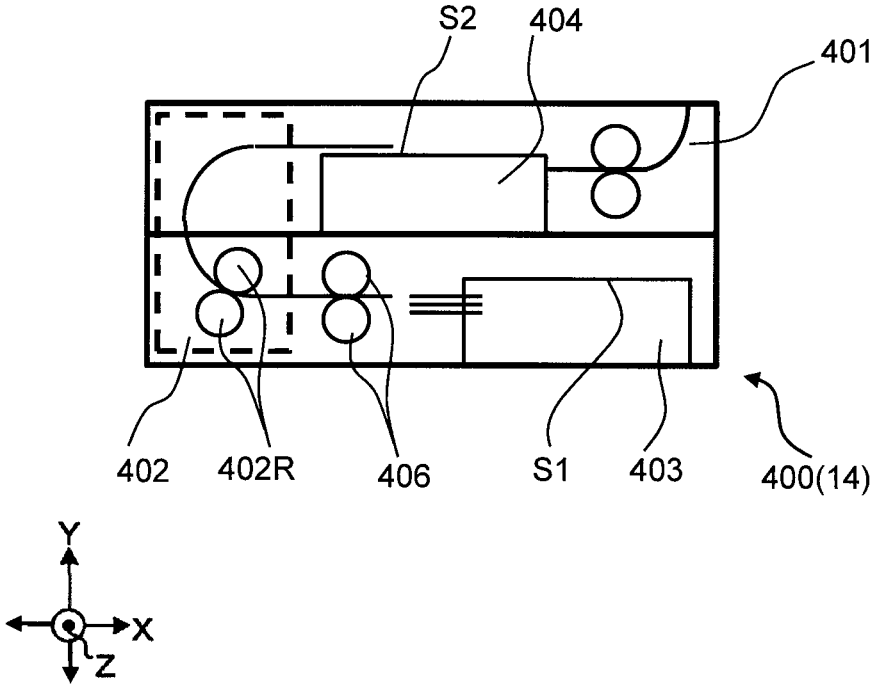
FIG. 2 is a sectional view schematically showing an erasing unit of the first embodiment connected with the image forming apparatus of FIG. 1.

FIG. 2 is a sectional view schematically showing an erasing apparatus of the first embodiment used for the image forming apparatus of FIG. 1.

As shown in FIG. 1 and FIG. 2, the erasing apparatus 400 (described later) is a unit apparatus, and connectably and detachably attached to the image forming apparatus. Hereinafter, the erasing apparatus 400 will be referred to as the erasing unit 400.

The image forming apparatus 1 includes the image forming apparatus main body 100, the first feeder unit 200, the second feeder unit 300, and the erasing unit 400.

According to the standard specs, the first feeder unit 200 is attached to the image forming apparatus main body 100. Specifically, for example, the first feeder unit 200 is, for example, fixedly attached to the image forming apparatus main body 100. The first feeder unit 200 includes an storage unit that stores a predetermined volume of sheets, and supplies the sheets, on which images are to be formed, to the image forming apparatus main body 100.

One of the second feeder unit 300 and the erasing unit 400 is attached to the image forming apparatus main body 100, optionally.

Specifically, one of the second feeder unit 300 and the erasing unit 400 is connectably and detachably attached to the image forming apparatus main body 100, the first feeder unit 200 being interposed therebetween.

More specifically, in place of the second feeder unit 300, the erasing unit 400 is connectably and detachably attached to the image forming apparatus main body 100, the first feeder unit 200 being interposed therebetween. In other words, in place of the erasing unit 400, the second feeder unit 300 is connectably and detachably attached to the image forming apparatus main body 100, the first feeder unit 200 being interposed therebetween.

Here, "connectably" and "detachably" means that a user or a serviceman may attach and detach the second feeder unit 300 and the erasing unit 400.

The second feeder unit 300 includes a storage unit that stores sheet, the volume of which is larger than that of the first feeder unit 200. The second feeder unit 300 supplies the sheets, on which images are to be formed, to the image forming apparatus main body 100.

The first feeder unit 200 and the second feeder unit 300 store, for example, unused sheets on which no image is formed.

The erasing unit 400 stores unerased sheets S1, on which images are formed. The erasing unit 400 erases images, which are formed on the sheets stored in the erasing unit 400. Further, the erasing unit 400 supplies the erased sheets S2, from which images are erased and on which images are to be formed, to the image forming apparatus main body 100.

So when the erasing unit 400 is connected, the image forming apparatus 1 has the erasing function.

Note that, in this embodiment, to "erase" means to make an image, which is formed with a color different from the basic color of the sheet, invisible visually. The "color different from the basic color of the sheet" includes not only chromatic colors but also achromatic colors (white, black, and the like). To "make invisible visually" includes to decolor (make transparent) an image, which is formed with a color different from the basic color of the sheet. To "make invisible visually" further includes to change the color of an image, which is formed with a color different from the basic color of the sheet, to the color the same as or similar to the basic color of the sheet.

The image forming apparatus 1 of this embodiment includes the first casing 11, the second casing 12, the third casing 14, and the fourth casing 13.

The first casing 11 includes a housing such as, for example, a frame that supports and stores components and the like structuring the image forming apparatus main body 100.

The second casing 12 includes a housing such as, for example, a frame that supports and stores components and the like structuring the first feeder unit 200.

The third casing 14 includes a housing such as, for example, a frame that supports and stores components and the like structuring the erasing unit 400.

The fourth casing 13 includes a housing such as, for example, a frame that supports and stores components and the like structuring the second feeder unit 300.

In FIG. 1, the second casing 12 is, for example, fixedly attached to the lower portion of the first casing 11 (bottom portion of the first casing 11 of FIG. 1). The second casing 12 is attached to the first casing 11, and thereby the first feeder unit 200 is attached to the image forming apparatus main body 100, as described above.

One of the third casing 14 and the fourth casing 13 is connectably and detachably attached to the lower portion of the second casing 12 (bottom portion of the second casing 12 of FIG. 1). One of the third and fourth casings 13, 14 is attached to the second casing 12, and thereby one of the second feeder unit 300 and the erasing unit 400 is connectably and detachably attached to the image forming apparatus main body 100, as described above, the first feeder unit 200 being interposed therebetween.

Note that the first and second casings 11, 12 may have the same structure or different structures.

The structure of the fourth casing 13 is different from the structures of the first to third casings 11, 12, 14. Since the structure of the fourth casing 13 is different from the structures of the first to third casings 11, 12, 14, and since the second feeder unit 300 is connectably and detachably attached to the image forming apparatus main body 100, as described above, the second feeder unit 300 is formed as a unit.

The structure of the third casing 14 is different from the structures of the first casing 11, the second casing 12, and the fourth casing 13. Since the structure of the third casing 14 is different from the structures of the other casings 11-13, and since the erasing unit 400 is connectably and detachably attached to the image forming apparatus main body 100, as described above, the erasing unit 400 is formed as a unit.

As shown in FIG. 1, the image forming apparatus main body 100 includes the printer device 120 and the fusing device 102 as devices for the image formation process.

The printer device 120 forms an image, based on document image data, on a sheet supplied from any one unit, i.e., the first feeder unit 200, the second feeder unit 300, or the erasing unit 400 connected in place of the second feeder unit 300.

For example, the printer device 120 forms an image by using an electrophotographic process as the image formation process. Specifically, the printer device 120 uses a toner as a color material, and forms an image of the toner on a photoreceptor based on document image data. The printer device 120 transfers the image of the toner from the photoreceptor to a sheet, and thereby forms the image on the sheet.

The fusing device 102 fuses the image (image of toner) formed on the sheet.

Further, the image forming apparatus main body 100 includes the scanner device 103, a discharge unit (not shown), an operation/display unit (not shown), and the like.

The scanner device 103 scans an image of a document, and thereby outputs the document image data. The image forming apparatus main body 100 may not only obtain document image data from the scanner device 103, but also obtain document image data from an external apparatus via a communication unit (not shown).

The discharge unit receives, outside of the image forming apparatus main body 100, a sheet with an image fused by the fusing device 102.

The operation/display unit receives instruction information from a user. The instruction information includes an image formation instruction, an erasing instruction, a selected feeding method, and the like.

The image forming apparatus main body 100 forms an image by using the printer device 120, the fusing device 102, and the like in response to the received image formation instruction input by using the operation/display unit.

Further, the image forming apparatus main body 100 conveys a sheet supplied from any one unit (i.e., the first feeder unit 200, the second feeder unit 300, or the erasing unit 400 attached in placed of the second feeder unit 300) to the printer device 120 in response to the received feeding method input by using the operation/display unit.

The image forming apparatus main body 100 erases an image formed on the unerased sheet S1 by using the erasing unit 400 in response to the received erasing instruction input by using the operation/display unit.

Further, the operation/display unit displays information such as the status of the image forming apparatus main body 100 and the status of the erasing unit 400.

Further, the image forming apparatus main body 100 includes the first conveying path 101 that conveys sheets.

In FIG. 1, the first conveying path 101 is at the right end position in the first casing 11.

The first feeder unit 200 includes the second conveying path 201 that conveys sheets.

In FIG. 1, the second conveying path 201 is at the right end position in the second casing 12, similar to the first conveying path 101 in the first casing 11.

The second feeder unit 300 includes the fourth conveying path 301 that conveys sheets.

In FIG. 1, the fourth conveying path 301 is at the right end position in the fourth casing 13, similar to the second conveying path 201 in the second casing 12.

So, when the first casing 11, the second casing 12, and the fourth casing 13 are connected to each other, the first conveying path 101, the second conveying path 201, and the fourth conveying path 301 are connected to each other to thereby form one conveying pathway. The one conveying pathway communicates with the printer device 120 and the fusing device 102.

Specifically, the first conveying path 101 is the conveying path from the lower portion of the first casing 11 to the discharge unit.

The second conveying path 201 is the conveying path from the lower portion of the second casing 12 to the upper portion thereof.

The fourth conveying path 301 is the conveying path from the sheet-storage unit of the second feeder unit 300 to the upper portion of the fourth casing 13.

So the first conveying path 101 is connected to the second conveying path 201 at the lower portion of the first casing 11.

The second conveying path 201 is connected to the first conveying path 101 at the upper portion of the second casing 12, and connected to the fourth conveying path 301 at the lower portion of the second casing 12.

The fourth conveying path 301 is connected to the second conveying path 201 at the upper portion of the fourth casing 13.

As described above, the first feeder unit 200 includes a storage unit that stores a predetermined volume of sheets.

Specifically, the first feeder unit 200 includes a paper cassette as a sheet-storage unit.

For example, the second casing supports the paper cassette movably into and out of the first feeder unit 200.

A user places sheets in the paper cassette, and the sheets are stored in the first feeder unit 200.

Further, the first feeder unit 200 removes a sheet from the paper cassette by using feed rollers (not shown), and supplies the removed sheet to the second conveying path 201.

The second conveying path 201 conveys the sheet from the paper cassette to the first conveying path 101. The first conveying path 101 conveys the sheet from the second conveying path 201 to the printer device 120.

The printer device 120 forms an image on the conveyed sheet, as described above. The first conveying path 101 further conveys the sheet, on which the image is formed, to the fusing device 102. The fusing device 102 fuses the image on the conveyed sheet, as described above. The first conveying path 101 discharges the sheet, on which the image is fused, to the discharge unit.

As described above, in place of the third casing 14, the fourth casing 13 is connectably and detachably attached to the second casing 12.

With this structure, in place of the erasing unit 400, the second feeder unit 300 is connectably and detachably attached to the first feeder unit 200, which is attached to the image forming apparatus main body 100.

To the contrary, in place of the fourth casing 13, the third casing 14 is connectably and detachably attached to the second casing 12, as described above.

With this structure, in place of the second feeder unit 300, the erasing unit 400 is connectably and detachably attached to the first feeder unit 200, which is attached to the image forming apparatus main body 100.

The erasing unit 400 includes the third conveying path 401 that conveys sheets.

In FIG. 1, the third conveying path 401 is at the right end position in the third casing 14, similar to the second conveying path 201 in the second casing 12.

The third conveying path 401 is a conveying path from the second sheet stack 404 (described later, see FIG. 2) or from the discharge conveying paths 405A, 405B (described later, see FIG. 6) to the upper portion of the third casing 14.

When the first casing 11, the second casing 12, and the fourth casing 13 are connected to each other, the first conveying path 101, the second conveying path 201, and the third conveying path 401 are connected to each other to thereby form one conveying pathway. The one conveying pathway communicates with the printer device 120 and the fusing device 102.

In this embodiment, the erasing unit 400 includes not only the third conveying path 401 but also the erasing processing section of FIG. 2. The erasing processing section includes the erasing device 402, the first sheet stack 403, and the second sheet stack 404.

The erasing device 402 heats an image formed on a sheet with, for example, an erasable color material (for example, toner or ink) at an erasing temperature or more, and thereby erases the image. The erasing device 402 includes the pair of heat rollers 402R, which heat the sheet at the erasing temperature or more and convey the sheet at the same time. The heat rollers 402R include heaters that heat the sheet. The heat rollers 402R convey the erased sheet S2, from which the image is erased, to the second sheet stack 404.

The first sheet stack 403 stores the sheets, on which images are formed with an erasable color material, i.e., the unerased sheets S1, in a layered manner.

The second sheet stack 404 stores the erased sheets S2, from which images are erased by the erasing device 402, in a layered manner.

The second sheet stack 404 plays a role of a buffer, which temporarily accumulates the erased sheets S2 or preliminarily accumulates the erased sheets S2.

In FIG. 2, the perpendicular three-axis directions will be referred to as X axis, Y axis, and Z axis.

The X-axis direction (horizontal direction of FIG. 2) is the supply direction of supplying the unerased sheet S1 from the first sheet stack 403 to the erasing device.

The Y-axis direction (vertical direction of FIG. 2) is perpendicular to the supply direction, and perpendicular to the surface of the supplied unerased sheet S1.

The Z-axis direction (front-back direction of the image forming apparatus 1 of FIG. 1) is perpendicular to the supply direction, and in parallel with the surface of the supplied unerased sheet S1.

The third casing 14 supports the erasing device 402, the first sheet stack 403, and the second sheet stack 404 slidably in the Z-axis direction movably into and out of the erasing unit 400 (the third casing 14) (described later).

A user pulls the first sheet stack 403 out of the erasing unit 400 (the third casing 14), and places the unerased sheets S1 in the first sheet stack 403.

With reference to FIG. 2, the erasing unit 400 will be described in detail.

As shown in FIG. 2, the third casing 14 of the erasing unit 400 has a top-to-bottom dual structure divided in the Y-axis direction.

In this embodiment, the erasing device 402 of the erasing unit 400 is at the left end position of the third casing 14 in the X-axis direction.

In FIG. 2, the heat rollers 402R of the erasing device 402 are arranged one above the other, and are pressurized in contact with each other.

The heat rollers 402R allow the unerased sheets S1 to pass therethrough at the portions pressurized in contact with each other. The double-deck second sheet stack 404 and first sheet stack 403 are arranged separately in the third casing 14 top-to-bottom in the Y-axis direction.

The first sheet stack 403 arranged in the lower portion of the third casing 14 stores the unerased sheets S1, as described above.

The second sheet stack 404 arranged in the upper portion of the third casing 14 stores the erased sheets S2, as described above.

The erasing device 402 is at the left end position of the third casing 14 from the upper portion of the third casing 14, in which the second sheet stack 404 is arranged, to the lower portion of the third casing 14, in which the first sheet stack 403 is arranged.

Alternatively, the first sheet stack 403 may be arranged in the upper portion, and the second sheet stack 404 may be arranged in the lower portion.

Further, as shown in FIG. 2, the erasing processing section of the erasing unit 400 includes the feed rollers 406.

The feed rollers 406 are arranged upstream of the erasing device 402 in the supply direction (X-axis direction) of the unerased sheets S1 supplied from the first sheet stack 403 to the erasing device 402. The feed rollers 406 supply the unerased sheets S1 stored in the first sheet stack 403 to the heat rollers 402R of the erasing device 402. As described above, the erasing device 402 heats an image formed on a sheet with an erasable color material (for example, erasable toner) at the erasing temperature or more by using the heat rollers 402R, and thereby erases the image.

As shown in FIG. 2, the third conveying path 401 discharges the erased sheets S2 from the second sheet stack 404. Further, the third conveying path 401 is connected to the second conveying path 201, where the third casing 14 is connected to the second casing 12. The third conveying path 401 supplies the erased sheets S2 to the first conveying path 101 via the second conveying path 201.

Figure 3:
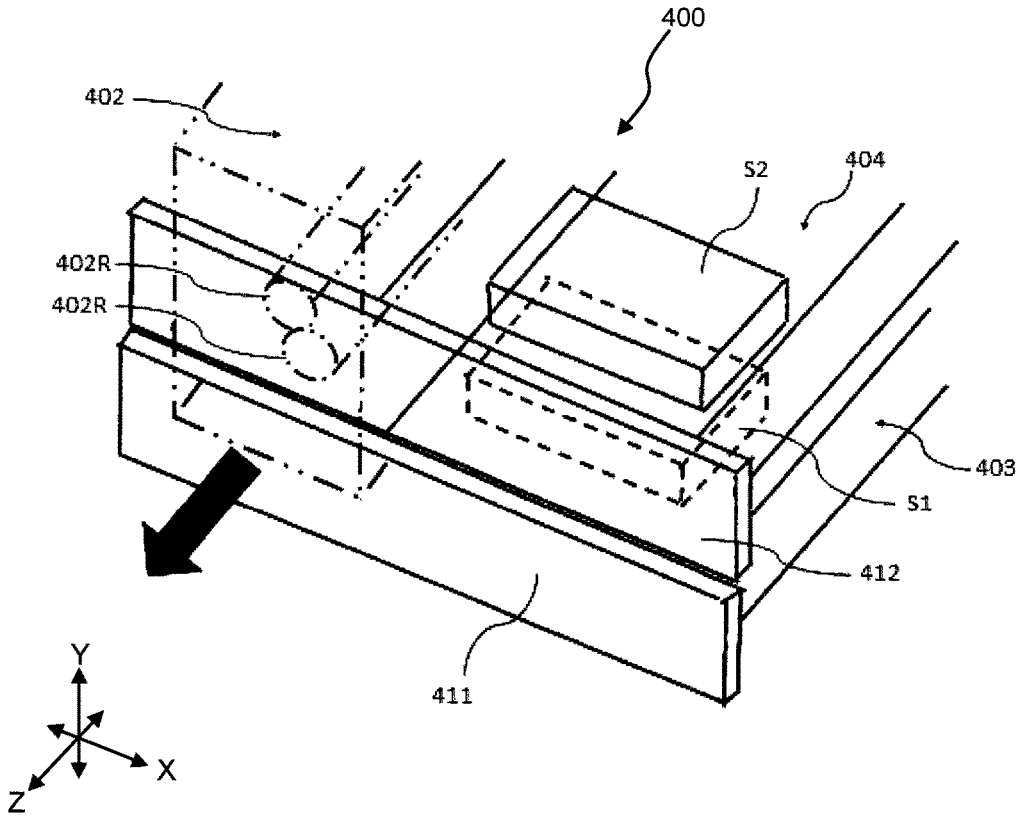
FIG. 3 is a perspective view schematically showing part (front surface side) of the erasing unit of FIG. 2, which appears first when the erasing unit is moved out of the third casing.

With reference to FIG. 3 to FIG. 5, the slidable structures of the erasing device 402, the first sheet stack 403, and the second sheet stack 404, which are movable into and out of the erasing unit 400 (the third casing 14) will be described in detail.

In the following description, the surfaces of the erasing device 402, the first sheet stack 403, and the second sheet stack 404, which appear first when they are moved out of the erasing unit 400, will sometimes be referred to as "front surfaces".

The double-deck second sheet stack 404 and first sheet stack 403, which are arranged separately top-to-bottom, include restricting members, which restrict the order of appearance out of the third casing 14 of the erasing device 402, and the first sheet stack 403 and the second sheet stack 404.

Thanks to the restricting members, the erasing device 402 is slidable to get out of the third casing 14 only after the first sheet stack 403 and the second sheet stack 404 slide in the Z-axis direction and get out of the third casing 14.

In other words, as shown in FIG. 3, the first sheet stack 403 and the second sheet stack 404 include, as the restricting members, the first exterior cover 411 and the second exterior cover 412 attached to the front surfaces of those stacks.

The first exterior cover 411 and the second exterior cover 412 are individual separate exterior covers.

The first exterior cover 411 and the second exterior cover 412 cover the entire front surface of the third casing 14 in the X-axis direction.

The first exterior cover 411 covers part of the front surface of the third casing 14 corresponding to the front surface of the first sheet stack 403 and thereby covers part of the front surface of the third casing 14 corresponding to the lower half of the front surface of the erasing device 402 in the third casing 14.

The first exterior cover 411 and the second exterior cover 412 are long enough to extend to cover the front surface of the erasing device 402, to thereby restrict slide of the erasing device 402 to get out of the third casing 14.

Specifically, the length of the first exterior cover 411 in the X-axis direction is approximately the same as the length of the third casing 14 in the X-axis direction. In other words, the length of the first exterior cover 411 in the X-axis direction is equal to or larger than the total length of the length of the first sheet stack 403 in the X-axis direction and the length of the erasing device 402 in the X-axis direction.

Further, the second exterior cover 412 covers part of the front surface of the third casing 14 corresponding to the front surface of the second sheet stack 404, and thereby covers part of the front surface of the third casing 14 corresponding to the upper half of the front surface of the erasing device 402. Specifically, similar to the first exterior cover 411, the length of the second exterior cover 412 in the X-axis direction is approximately the same as the length of the third casing 14 in the X-axis direction. In other words, the length of the second exterior cover 412 in the X-axis direction is equal to or larger than the total length of the length of the second sheet stack 404 in the X-axis direction and the length of the erasing device 402 in the X-axis direction.

The design and the color of the first exterior cover 411 and the second exterior cover 412 may be the same as or different from those of the front surface cover of the first feeder unit 200.

The third casing 14 includes support members such as rails that support the first sheet stack 403 slidably in the Z-axis direction.

Figure 4A:
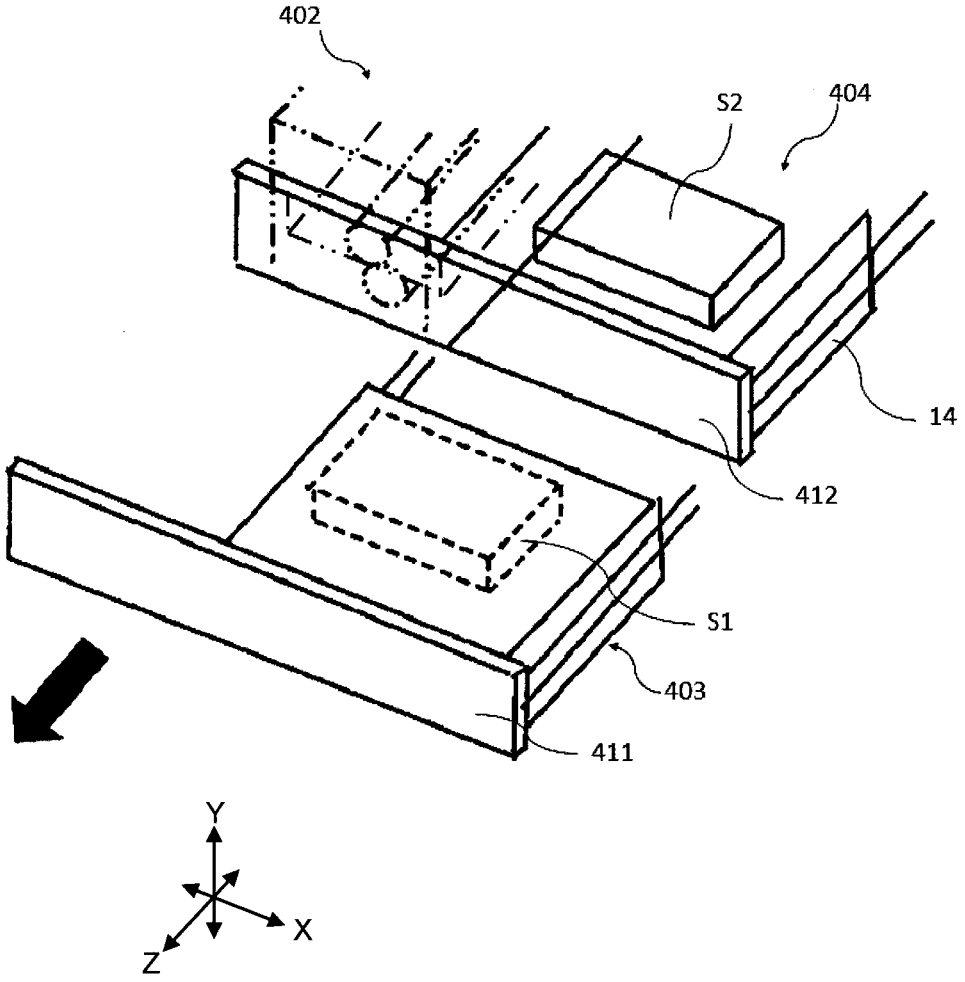
FIG. 4A is a perspective view schematically showing that the first sheet stack of the erasing unit of FIG. 3 is moved out of the third casing.

As shown in FIG. 4A, the support members of the third casing 14 help the first sheet stack 403 to get out of the third casing 14 individually from the front surface side.

In other words, the first sheet stack 403 is capable of getting out of the third casing 14 independently of the erasing device 402 and the second sheet stack 404.

Further, the first sheet stack 403 is capable of getting out of the third casing 14 independently of the erasing device 402 and the second sheet stack 404, which have got out of the third casing 14.

Note that the third casing 14 may include a locking mechanism, which locks the first sheet stack 403 not to slidably get out of the third casing 14.

Further, the third casing 14 includes support members such as rails that support the second sheet stack 404 slidably in the Z-axis direction.

Figure 4B:
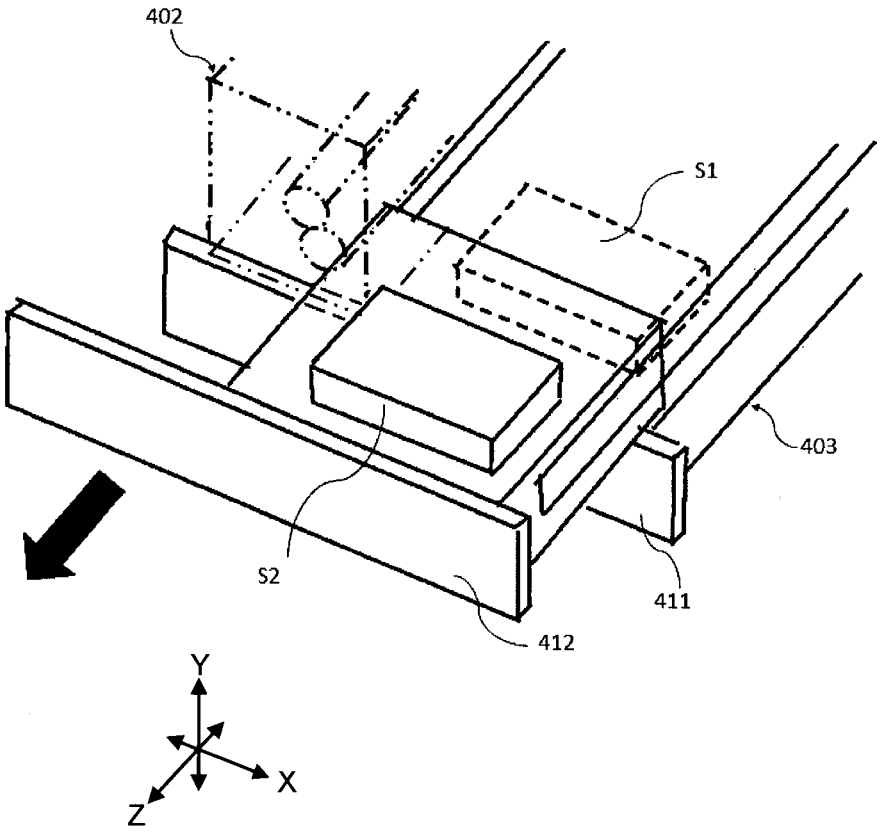
FIG. 4B is a perspective view schematically showing that the upper second sheet stack is moved out of the third casing of the erasing unit of FIG. 3.

As shown in FIG. 4B, the support members of the third casing 14 help the second sheet stack 404 to get out of the third casing 14 individually from the front surface side.

In other words, the second sheet stack 404 is capable of getting out of the third casing 14 independently of the erasing device 402 and the first sheet stack 403.

Further, the second sheet stack 404 is capable of getting out of the third casing 14 independently of the erasing device 402 and the first sheet stack 403, which have got out of the third casing 14.

Note that the third casing 14 may include a locking mechanism, which locks the second sheet stack 404 not to slidably get out of the third casing 14.

For example, by using the locking mechanism of the second sheet stack 404, the third casing 14 may lock the second sheet stack 404 not to slidably get out of the third casing 14, when the first sheet stack 403 is in the third casing 14.

In other words, the second sheet stack 404 is a sheet storage portion, which stores the erased sheets S2 erased by the erasing device 402, and is not like a sheet storage portion such as the first sheet stack 403, in which a user places sheets from outside.

So it is necessary for a user to get out of the second sheet stack 404 only when he has to clear a paper jam of the second sheet stack 404, for example.

So, by using the locking mechanism for the second sheet stack 404, the third casing 14 may lock the second sheet stack 404 not to slidably get out of the third casing 14, when the first sheet stack 403 is in the third casing 14. In addition, by using the locking mechanism for the second sheet stack 404, the third casing 14 may unlock the second sheet stack 404 to be slidable for the first time after the first sheet stack 403 gets out of the third casing 14 (status of FIG. 4A). Thanks to the locking mechanism for the second sheet stack, it is possible to prevent the second sheet stack 404 from being got out of the third casing 14 carelessly by a user.

As the locking mechanism for the first or second sheet stack, a locking mechanism having a known structure may be used.

Further, the third casing 14 includes support members such as rails that support the erasing device 402 slidably in the Z-axis direction.

The support members of the third casing 14 help the erasing device 402 to get out of the third casing 14 individually from the front surface side.

In other words, the erasing device 402 is capable of getting out of the third casing 14 independently of the first and second sheet stacks 403, 404.

Note that, as described above, the first exterior cover 411 and the second exterior cover 412 cover part of the front surface of the third casing 14 corresponding to the front surface of the erasing device 402.

So, as shown in FIG. 4A or FIG. 4B, when any one of the first and second sheet stacks 403, 404 is not got out of the third casing 14, thanks to the first exterior cover 411 or the second exterior cover 412, it is possible to prevent the erasing device 402 from sliding in the Z-axis direction.

Figure 5A:
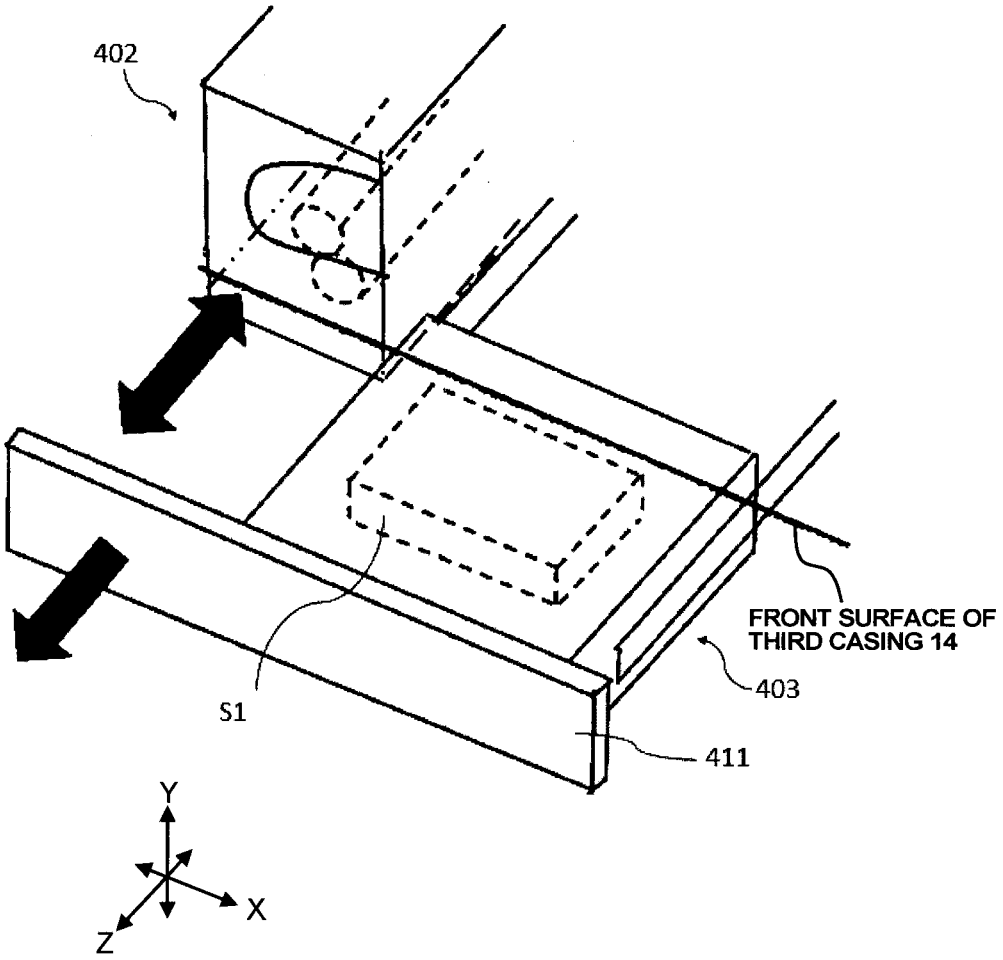
FIG. 5A is a perspective view illustrating an order of appearance of the erasing device out of the third casing of the erasing unit of FIG. 3.
Figure 5B:
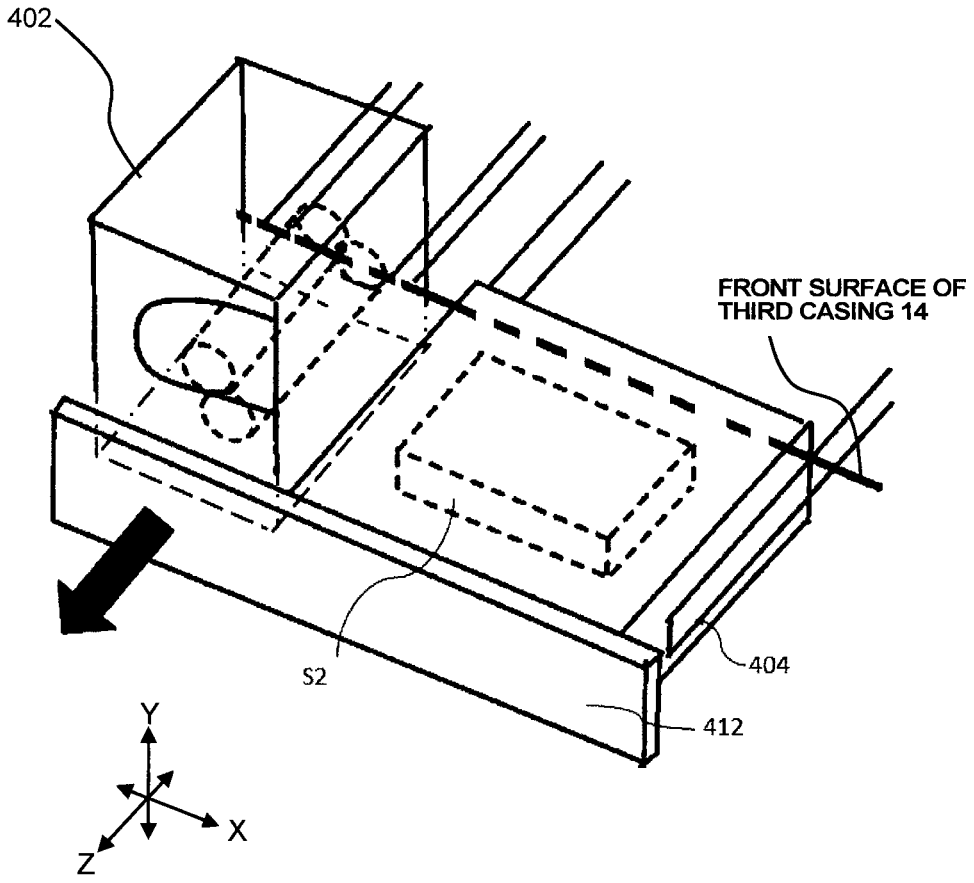
FIG. 5B is a perspective view illustrating an order of appearance of the erasing device out of the third casing of the erasing unit of FIG. 3.

FIG. 5A shows the first sheet stack 403 out of the third casing 14. FIG. 5B shows the erasing device 402 out of the third casing 14 after the second sheet stack 404 got out of the third casing 14 after the status of FIG. 5A.

In other words, after the first sheet stack 403 got out of the third casing 14 as shown in FIG. 5A and after the second sheet stack 404 got out of the third casing 14 as shown in FIG. 5B, it is possible for the erasing device 402 to slide to get out of the third casing 14.

In other words, the erasing device 402 can get out of the third casing 14 only after the first and second sheet stacks 403, 404 got out of the third casing 14.

According to this embodiment, in place of the feeder (the second feeder unit 300) of the image forming apparatus 1, the erasing unit 400, i.e., an independent structural unit, may be attached to the image forming apparatus 1.

Further, the first sheet stack 403, the second sheet stack 404, and the erasing device 402 are capable of getting out of the third casing 14 of the erasing unit 400 one by one by sliding in the Z-axis direction.

So it is possible to remove a component only necessary for a user out of the erasing unit 400, and to repair the component or place a new component.

Further, according to this embodiment, even if the first sheet stack 403 or the second sheet stack 404 has got out of the erasing unit 400 (the third casing 14), the erasing device 402 is remained in the third casing 14.

In other words, the erasing device 402 cannot be removed carelessly by a user. So the heating temperature of the erasing device 402 may hardly drop.

So, when performing the erasing processing immediately after a user places the first sheet stack 403 or the second sheet stack 404 in the third casing 14, the temperature of the erasing device 402 is raised to the predetermined heating temperature in a short time.

Note that, in the erasing unit 400 of this embodiment, a sensor may be provided between the erasing device 402 and the second sheet stack 404 to detect a torn erased sheet S2 and the like. When the sensor detects a torn erased sheet S2 and the like, the image forming apparatus 1 displays a message such as "Erased sheet S2 is torn", for example, by using the operation/display unit to give notice to a user. Further, the image forming apparatus 1 stops supplying the erased sheets S2 from the erasing unit 400 to the image forming apparatus main body 100.

As described above, when the image forming apparatus 1 stops supplying the erased sheets S2 from the erasing unit 400, the image forming apparatus 1 may supply sheets from the first feeder unit 200 to the image forming apparatus main body 100, for example.

Second Embodiment

Hereinafter, the second embodiment will be described.

The image forming apparatus of the second embodiment is the same as the image forming apparatus 1 of the first embodiment except for the structure of the erasing unit. So, in the following description, the erasing unit of the second embodiment will be described in detail with reference to FIG. 6.

Figure 6:
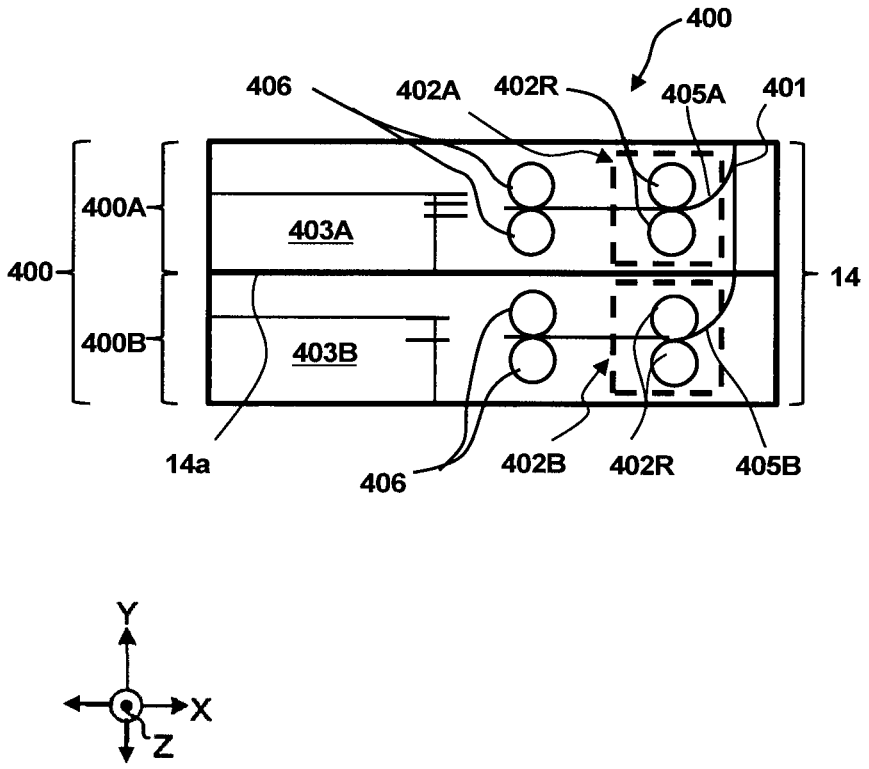
FIG. 6 is a sectional view schematically showing the erasing unit of the second embodiment.

FIG. 6 is a diagram schematically showing the erasing unit of the second embodiment.

The erasing unit 400 of this embodiment includes the first erasing unit 400A and the second erasing unit 400B.

As shown in FIG. 6, the double-deck first erasing unit 400A and second erasing unit 400B are arranged separately in the third casing 14 of the erasing unit 400 top-to-bottom in the Y-axis direction.

The structure of the first erasing unit 400A is the same as the structure of the second erasing unit 400B.

The first erasing unit 400A includes the first sheet stack 403A, the erasing device 402A, the discharge conveying path 405 A, and the feed rollers 406.

The first sheet stack 403A is at an end (left end of FIG. 6) position of the third casing 14 in the X-axis direction.

The first sheet stack 403A stores the unerased sheets S1 in a layered manner.

In FIG. 6, the erasing device 402A is at a position opposite to the position of the first sheet stack 403A in the third casing 14.

Similar to the first embodiment, the erasing device 402A includes heat rollers that erase images from the unerased sheets S1.

The first erasing unit 400A supplies the unerased sheets S1 stored in the first sheet stack 403A to the erasing device 402A by using the feed rollers 406.

Unlike the erasing processing section of the first embodiment, the first erasing unit 400A includes no second sheet stack that stores the erased sheets S2.

So the first erasing unit 400A conveys the erased sheets S2, which are erased by the erasing device 402A, to the discharge conveying path 405A without storing them in a second sheet stack temporarily.

The discharge conveying path 405A discharges the erased sheets S2 from the first erasing unit 400A, and supplies the erased sheets S2 to the third conveying path 401 (see FIG. 1).

The second erasing unit 400B includes the first sheet stack 403B, the erasing device 402B, the discharge conveying path 405 B, and the feed rollers 406.

The structures of the first sheet stack 403B, the erasing device 402B, the discharge conveying path 405 B, and the feed rollers 406 are the same as the structures of the first sheet stack 403A, the erasing device 402A, the discharge conveying path 405 A, and the feed rollers 406. So the description thereof will be omitted.

In FIG. 6, as described above, the first and second erasing units 400A, 400B of the erasing unit 400 include no second sheet stack.

As a result, the space for the erasing processing section may be reduced, and the erasing units 400A, 400B are arranged in the third casing 14 top-to-bottom in the Y-axis direction.

As shown in FIG. 6, the third casing 14 includes the partition plate 14*a*.

The partition plate 14*a* divides the third casing 14 into two in the vertical direction (Y-axis direction), and thereby the double-deck first and second erasing units 400A, 400B are arranged separately in the third casing 14 top-to-bottom.

The third casing 14 includes support members such as rails that support the first sheet stacks 403A, 403B slidably in order that the first sheet stacks 403A, 403B may be movable into and out of the front surface of the third casing 14.

Further, the third casing 14 includes support members such as rails that support the first sheet stacks 403A, 403B slidably in order that the erasing devices 402A, 402B may be movable into and out of the front surface of the third casing 14.

According to this embodiment, the erasing unit 400 may supply sheets to the image forming apparatus main body 100 (see FIG. 1) from the first and second erasing units 400A, 400B alternately.

So, for example, even if one erasing unit 400A has a trouble (e.g., erased sheet S2 is torn), the erasing unit 400 is capable of supplying the erased sheets S2 from the other erasing unit 400B to the image forming apparatus main body 100 (see FIG. 1).

Further, according to this embodiment, by using the first and second erasing units 400A, 400B alternately, the erasing unit 400 is capable of reducing user's wait time resulting from the erasing speed.

Third Embodiment

Hereinafter, the third embodiment will be described.

The image forming apparatus of the third embodiment is the same as the image forming apparatus 1 of the first embodiment except for the structure of the erasing unit. So, in the following description, the erasing unit of the third embodiment will be described in detail with reference to FIG. 7.

Figure 7:
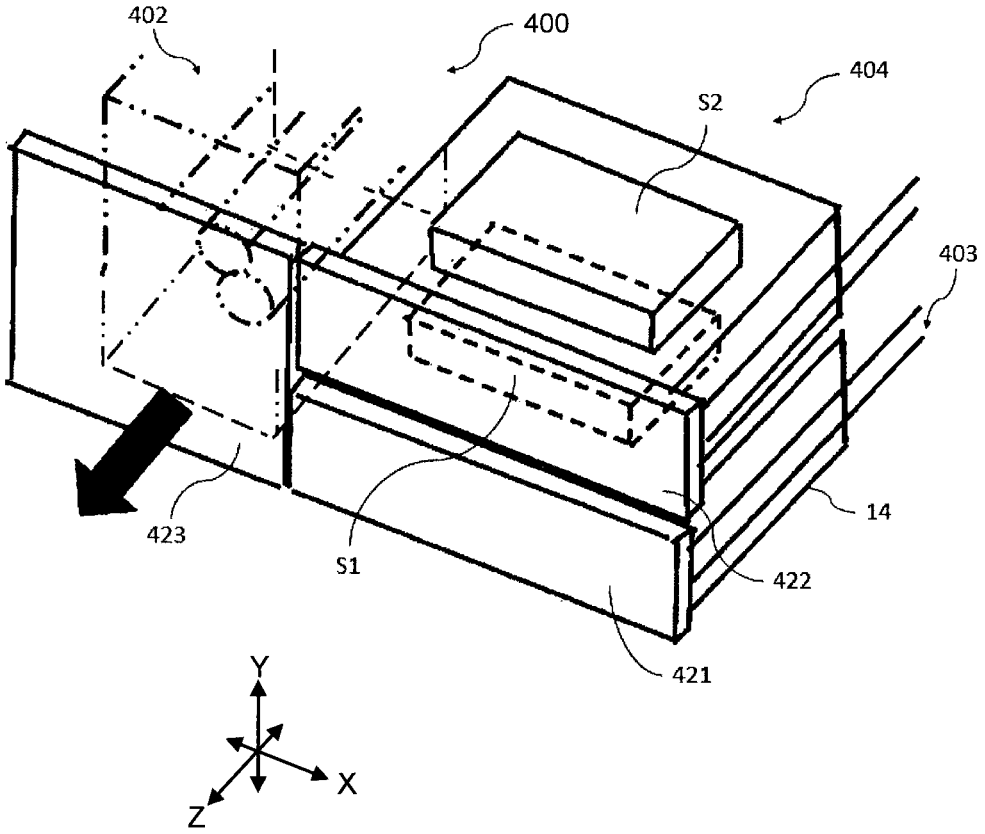
FIG. 7 is a perspective view schematically showing part (front surface side) of the erasing unit of the third embodiment, which appears first when the erasing unit is moved out of the third casing.

FIG. 7 is a perspective view schematically showing the front-surface-side part of the erasing unit of the third embodiment.

As shown in FIG. 7, similar to the erasing unit of the first embodiment, the erasing processing section of the erasing unit 400 includes the first sheet stack 403, the second sheet stack 404, and the erasing device 402, and the like. Further, similar to the erasing unit of the first embodiment, the third casing 14 of the erasing unit 400 includes support members such as rails that support the first sheet stack 403, the second sheet stack 404, and the erasing device 402 slidably in order that the first sheet stack 403, the second sheet stack 404, and the erasing device 402 may be movable into and out of the front surface of the third casing 14.

Note that, as shown in FIG. 7, according to this embodiment, the first sheet stack 403, the second sheet stack 404, and the erasing device 402 include the exterior covers 421, 422, 423, individually, unlike the first embodiment.

The length of the exterior cover 421 of the first sheet stack 403 is the same as the length of the first sheet stack 403 in the X-axis direction (width direction of the first sheet stack 403).

The length of the exterior cover 422 of the second sheet stack 404 is the same as the length of the second sheet stack 404 in the X-axis direction (width direction of the second sheet stack 404).

The length of the exterior cover 423 of the erasing device 402 is the same as the length of the erasing device 402 in the X-axis direction (width direction of the erasing device 402).

Thanks to the structures of the exterior covers 421-423, in the erasing unit 400 of this embodiment, there is no priority of the order of the first sheet stack 403, the second sheet stack 404, and the erasing device 402 getting out of the third casing 14. All of the first sheet stack 403, the second sheet stack 404, and the erasing device 402 are capable of sliding in the Z-axis direction to get out of the third casing irrespective of the other sheet stack and the erasing device or the sheet stacks, each of which is got out of the third casing 14 or is in the third casing 14.

So when a user wants to clear a paper jam in the erasing unit 400, for example, he can remove the erasing device 402 from the erasing unit 400 (the third casing 14) first.

Fourth Embodiment

Hereinafter, the fourth embodiment will be described.

The image forming apparatus of the fourth embodiment is the same as the image forming apparatus 1 of the first embodiment except for the structure of the erasing unit. So, in the following description, the erasing unit of the fourth embodiment will be described in detail with reference to FIG. 8.

In the fourth embodiment, similar to the erasing unit of the second embodiment, the erasing unit 400 includes the double-deck first and second erasing units 400A, 400B arranged separately in the third casing 14 top-to-bottom in the Y-axis direction (see FIG. 6).

As described above, the first erasing unit 400A includes the first sheet stack 403A, the erasing device 402A, the discharge conveying path 405 A, and the like.

The second erasing unit 400B includes the second sheet stack 403B, the erasing device 402B, the discharge conveying path 405 B, and the like.

Further, similar to the erasing unit of the second embodiment, the third casing 14 of the erasing unit 400 includes support members such as rails that support the first and second sheet stacks 403A, 403B and the erasing devices 402A, 402B slidably in the Z-axis direction in order that the first and second sheet stacks 403A, 403B and the erasing devices 402A, 402B may be movable into and out of the third casing 14.

Figure 8:
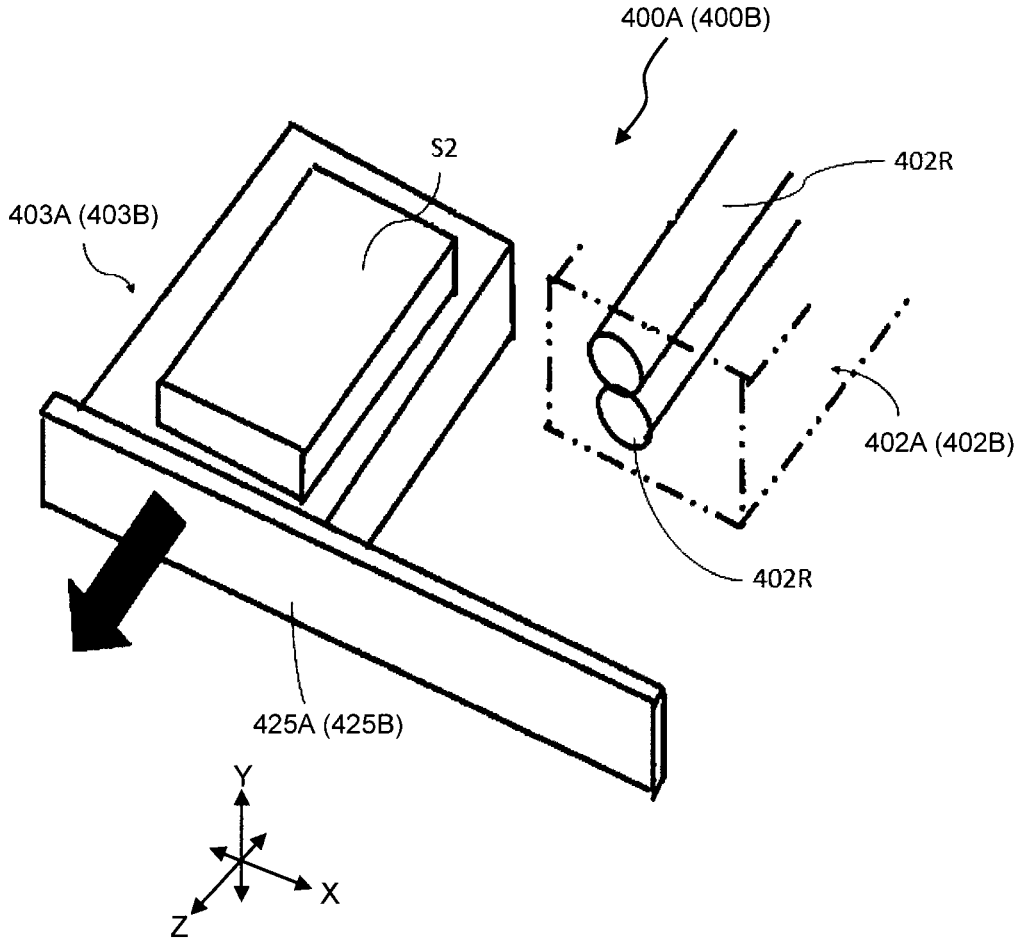
FIG. 8 is a perspective view schematically showing the exterior cover of the erasing unit of the fourth embodiment.

FIG. 8 is a perspective view schematically showing the front-surface-side part of the erasing unit 400 of the fourth embodiment.

As shown in FIG. 8, the first and second sheet stacks 403A, 403B include the exterior covers 425A, 425B.

The exterior covers 425A, 425B are attached to the front surfaces of the first and second sheet stacks 403A, 403B.

The length of the exterior cover 425A, 425B in the X-axis direction is approximately the same as the length of the third casing 14 (see FIG. 6) in the X-axis direction. In other words, the length of the exterior cover 425A, 425B in the X-axis direction is equal to or larger than the total length of the length of the first or second sheet stack 403A, 403B in the X-axis direction and the length of the erasing device 402A, 402B in the X-axis direction.

So the exterior covers 425A, 425B cover the front surface of the third casing 14 corresponding to the front surfaces of the erasing devices 402A, 402B.

Similar to the exterior covers of the first embodiment, the exterior covers 425A, 425B cover the third casing 14, and thereby function as restricting members that restrict slide of the erasing devices 402A, 402B to get out of the third casing 14.

So, according to this embodiment, after the upper first sheet stack 403A got out of the front surface side of the third casing 14, the upper erasing device 402A is capable of sliding in order to get out of the front surface side of the third casing 14.

Similarly, after the lower second sheet stack 403B got out of the front surface side of the third casing 14, the lower erasing device 402B is capable of sliding in order to get out of the front surface side of the third casing 14.

So, according to the erasing unit 400 of this embodiment, for example, it is possible to prevent the high-temperature erasing devices 402A, 402B from being touched by a user with his hand accidentally.

Fifth Embodiment

Hereinafter, the fifth embodiment will be described.

The image forming apparatus of the fifth embodiment is the same as the image forming apparatus 1 of the first embodiment except for the structure of the erasing unit. So, in the following description, the erasing unit of the fifth embodiment will be described in detail with reference to FIG. 9.

In the fifth embodiment, similar to the erasing unit of the second embodiment, the erasing unit 400 includes the double-deck first and second erasing units 400A, 400B arranged separately in the third casing 14 top-to-bottom in the Y-axis direction (see FIG. 6).

In other words, as described above, the first erasing unit 400A includes the first sheet stack 403A, the erasing device 402A, the discharge conveying path 405 A, and the like.

The second erasing unit 400B includes the second sheet stack 403B, the erasing device 402B, the discharge conveying path 405 B, and the like.

Further, similar to the erasing unit of the second embodiment, the third casing 14 of the erasing unit 400 includes support members such as rails that support the first and second sheet stacks 403A, 403B and the erasing devices 402A, 402B slidably in the Z-axis direction in order that the first and second sheet stacks 403A, 403B and the erasing devices 402A, 402B may be movable into and out of the third casing 14.

Figure 9:
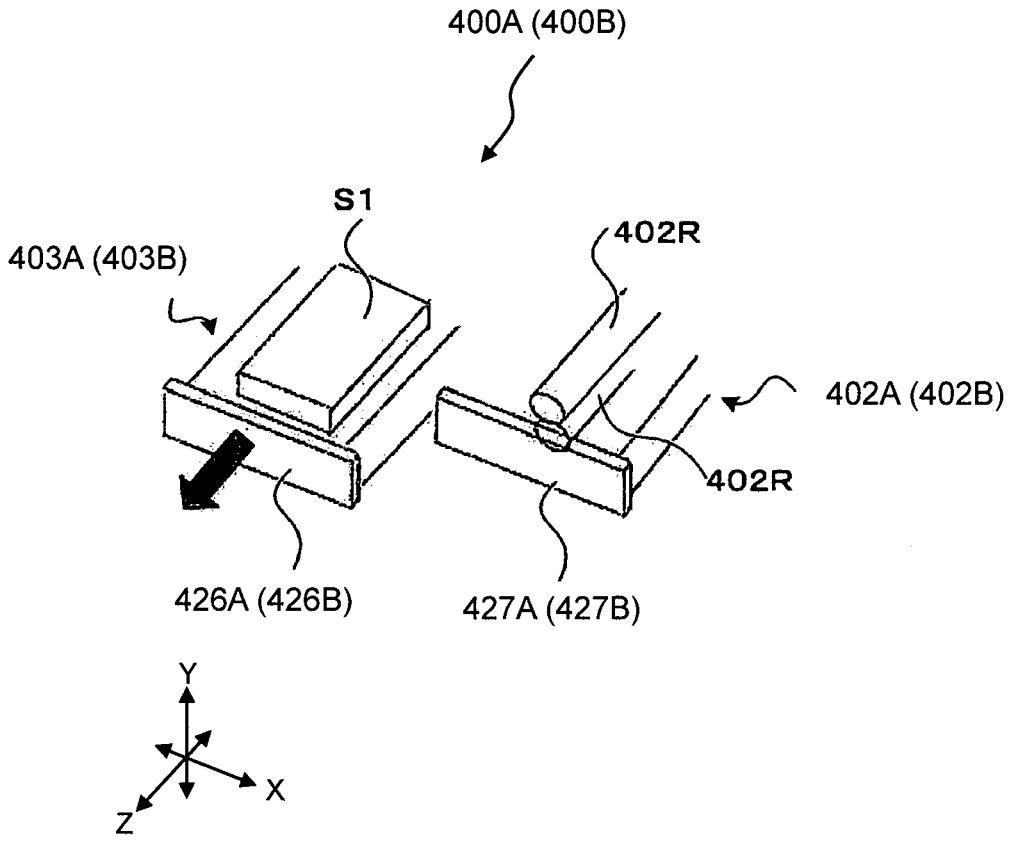
FIG. 9 is a perspective view schematically showing the exterior cover of the erasing unit of the fifth embodiment.

FIG. 9 is a perspective view schematically showing the front-surface-side part of the erasing unit 400 of the fifth embodiment.

As shown in FIG. 9, the first and second sheet stacks 403A, 403B include the exterior covers 426A, 426B. Further, the erasing devices 402A, 402B include the exterior covers 427A, 427B.

The exterior covers 426A, 426B are attached to the front surfaces of the first and second sheet stacks 403A, 403B.

The exterior covers 427A, 427B are attached to the front surfaces of the erasing devices 402A, 402B.

The length of the exterior covers 426A, 426B in the X-axis direction is approximately the same as the length of the first and second sheet stacks 403A, 403B in the X-axis direction.

The length of the exterior covers 427A, 427B in the X-axis direction is approximately the same as the length of the erasing devices 402A, 402B in the X-axis direction.

Thanks to the structures of the exterior covers 427A, 427B, the first and second sheet stacks 403A, 403B and the erasing devices 402A, 402B are capable of sliding in the Z-axis direction to get out of the third casing 14 irrespective of the other sheet stack(s) and the erasing device(s), each of which is got out of the third casing 14 or is in the third casing 14.

For example, a user is capable of removing any of the upper (lower) first sheet stacks 403A (403B) and the upper (lower) erasing devices 402A (402B) out of the front surface side of the third casing 14 as he like.

Further, a user is capable of placing any of the upper (lower) first sheet stacks 403A (403B) and the upper (lower) erasing devices 402A (402B) in the third casing 14.

So, for example, if a user has to remove only the upper erasing device 402A (the lower erasing device 402B) out of the front surface side of the third casing 14, it is not necessary to firstly remove the first sheet stack 403A (the second sheet stack 403B) out of the front surface side of the third casing 14.

Sixth Embodiment

Hereinafter, the sixth embodiment will be described.

The image forming apparatus of the sixth embodiment is the same as the image forming apparatus 1 of the first embodiment except for the structure of the erasing unit. So, in the following description, the erasing unit of the sixth embodiment will be described in detail with reference to FIG. 10.

According to the sixth embodiment, the erasing unit 400 includes the feeder unit 500 in place of the erasing unit (see FIG. 6) of the second embodiment or instead of the upper first erasing unit 400A of the erasing unit of the fourth embodiment (see FIG. 8).

Figure 10A:
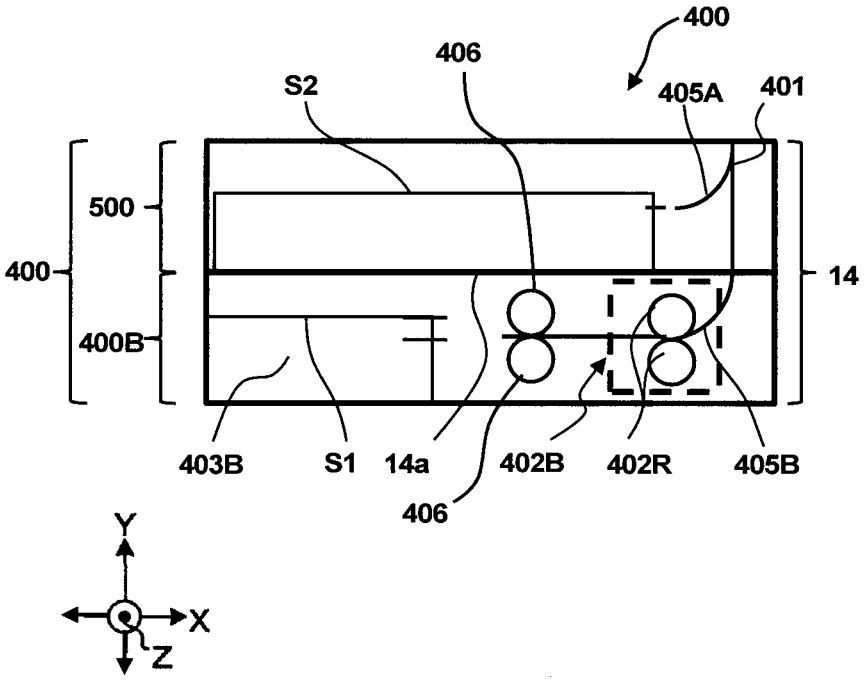
FIG. 10A is a sectional view schematically showing the erasing unit of the sixth embodiment.

Specifically, as shown in FIG. 10A, according to the sixth embodiment, the erasing unit 400 includes the feeder unit 500 and the second erasing unit 400B. The feeder unit 500 stores sheets, which are to be supplied to the image forming apparatus main body 100, in a layered manner. The feeder unit 500 may store the erased sheets S2 or unused sheets. A user removes the feeder unit 500 out of the third casing 14 of the erasing unit 400, and places the erased sheets S2 or the unused sheets therein.

Figure 10B:
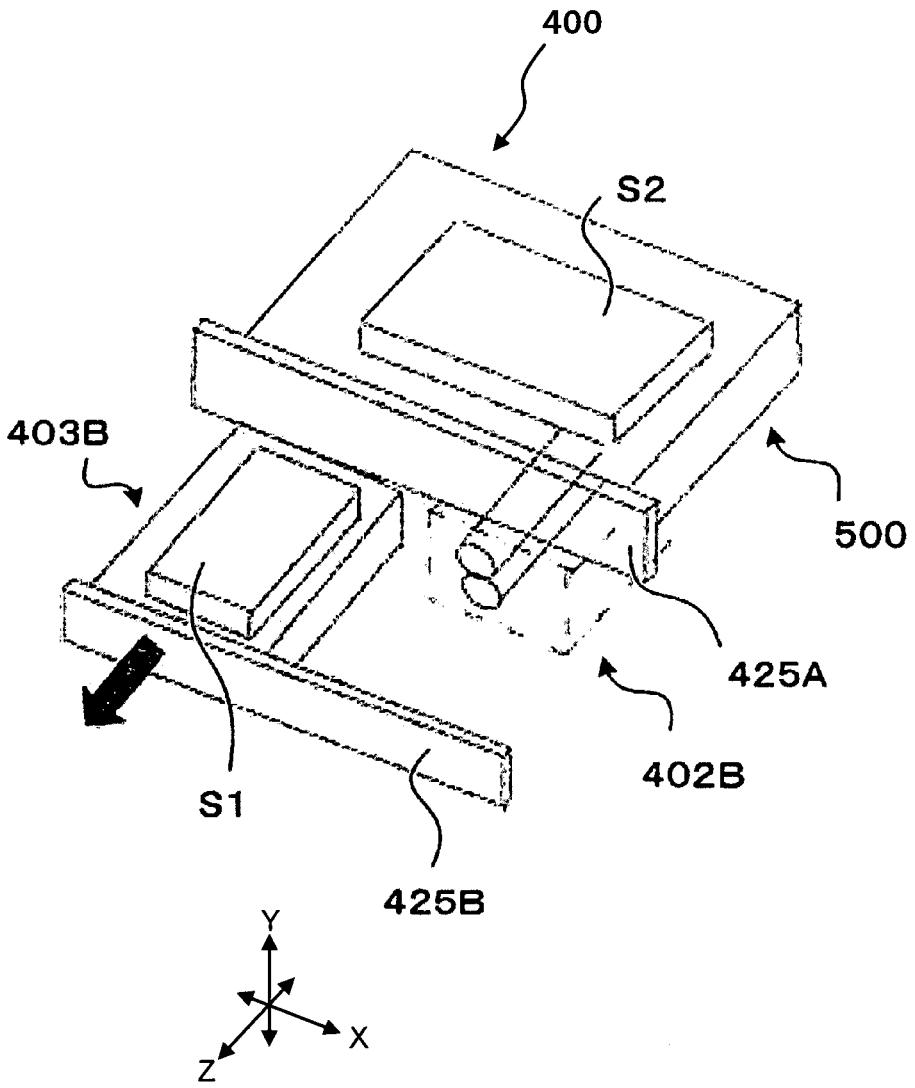
FIG. 10B is a perspective view schematically showing the erasing unit of the sixth embodiment.

As shown in FIG. 10B, the feeder unit 500 includes the exterior cover 425A, which is the same as the exterior cover 425A of the first sheet stack of the erasing unit (see FIG. 8) of the fourth embodiment.

Further, the width (length in X-axis direction) and the depth (length in Z-axis direction) of the feeder unit 500 are the same as those of the upper first erasing unit 400A of the erasing unit of the second embodiment or the fourth embodiment. However, the feeder unit 500 does not include the erasing device 402. So the feeder unit 500 is capable of storing sheets larger than the sheets, which the first sheet stack 403B can store, for example, since the space of the erasing device 402 is saved.

Seventh Embodiment

Hereinafter, the seventh embodiment will be described.

The image forming apparatus of the seventh embodiment is the same as the image forming apparatus 1 (see FIG. 1) of the first embodiment except for the structure of the erasing unit.

Further, the erasing unit of the seventh embodiment is the same as the erasing unit (see FIG. 7) of the third embodiment except for slide restricting members (described later). So, in the following description, the slide restricting members of the erasing unit of the seventh embodiment will be described in detail with reference to FIG. 11 to FIG. 14.

The erasing unit 400 includes slide restricting members that restrict slide of the erasing device 402 and the first and second sheet stacks 403, 404 to get out of the third casing 14.

The slide restricting members include locking mechanisms that restricts slide of the erasing device 402 and the first and second sheet stacks 403, 404 to get out of the third casing 14.

Further, the slide restricting members include unlocking mechanisms that remove the restriction of slide.

Figure 11:
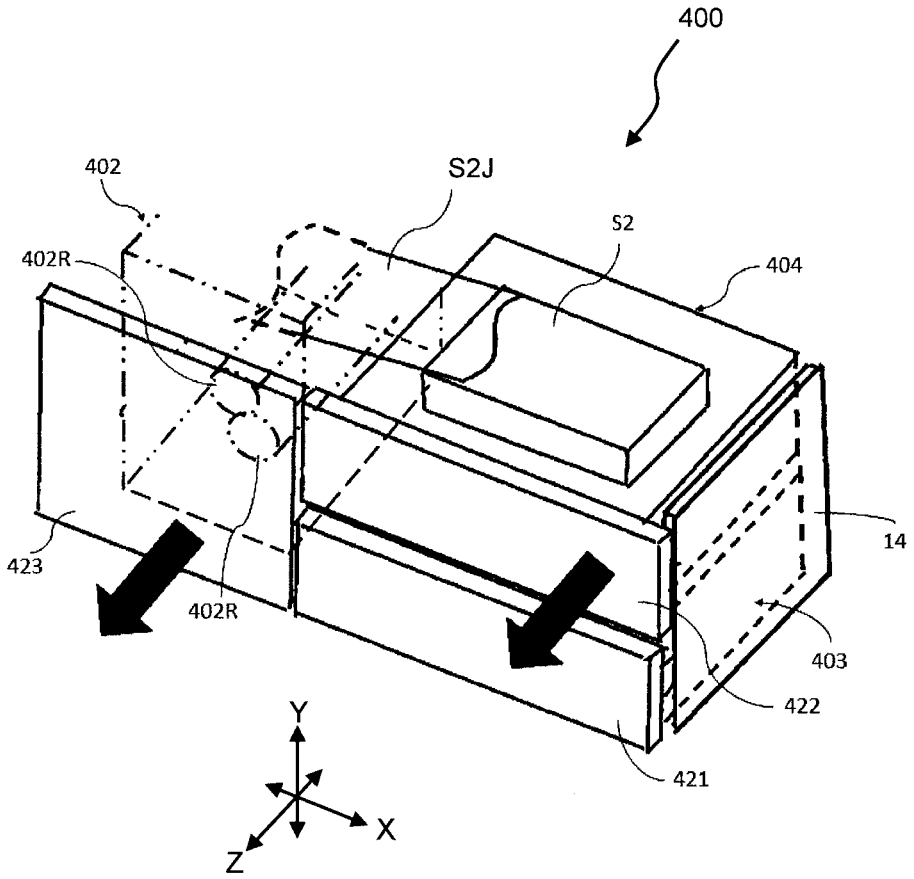
FIG. 11 is a perspective view schematically showing the erasing unit of the seventh embodiment.

In FIG. 11, according to the erasing unit 400 of this embodiment, the locking mechanisms restrict slide of the erasing device 402 and the first and second sheet stacks 403, 404 in order that the erasing device 402, the first sheet stack 403, and the second sheet stack 404 may get out of the front surface side of the third casing 14 in a unified manner.

For example, when a paper jam is caused in the erasing unit 400, a user can remove the erasing device 402, the first sheet stack 403, and the second sheet stack 404 out of the third casing 14 in a unified manner in order to clear the paper jam.

Further, after the erasing device 402, the first sheet stack 403, and the second sheet stack 404 are removed out of the front surface side of the third casing 14 of the erasing unit 400 in a unified manner, the erasing device 402, the first sheet stack 403, and the second sheet stack 404 can be returned in the third casing 14 independently.

Note that the erasing device 402 can be returned into the third casing 14 independently only after the first sheet stack 403 and the second sheet stack 404 returned into the third casing 14.

For example, as shown in FIG. 11, when a paper jam is occurred during discharging an erased sheet S2 from the erasing device 402, the jammed erased sheet S2 is between the second sheet stack 404 and the erasing device 402 (see S2J of FIG. 11).

Similarly, when a paper jam is occurred during supplying an unerased sheet S1 to the erasing device 402, the jammed unerased sheet S1 is between the first sheet stack 403 and the erasing device 402.

When a paper is jammed as described above, for example, if a user removes the erasing device 402 out of the front surface side of the third casing in order to clear the paper jam, the jammed sheet S2 (S1) is torn off, and thereby slips of paper and powder dusts of paper may remain in the erasing device 402.

In view of this, it is necessary to remove the sheet S2 (S1) out of the erasing unit 400 without damaging the sheet S2 (S1).

Figure 12:
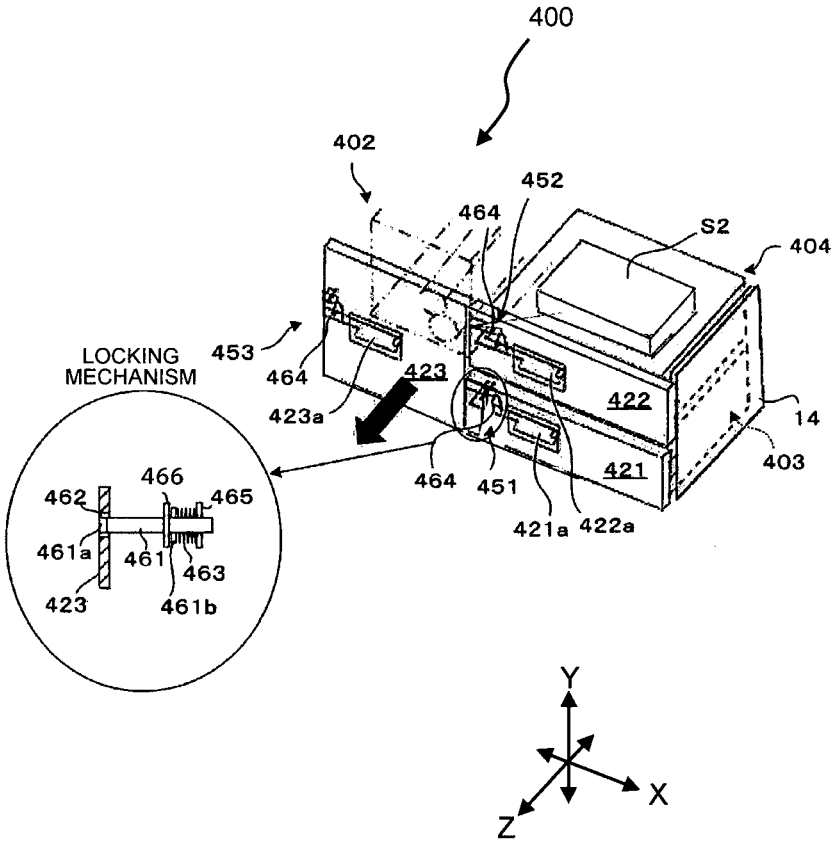
FIG. 12 is a perspective view showing the locking mechanism of the erasing unit of FIG. 11.

The locking mechanisms of the erasing unit 400 will be described in detail with reference to FIG. 12. As shown in FIG. 12, the locking mechanisms include the first locking mechanism 451, the second locking mechanism 452, and the third locking mechanism 453.

The first locking mechanism 451 locks the first sheet stack 403 and the erasing device 402.

The second locking mechanism 452 locks the second sheet stack 404 and the erasing device 402.

The third locking mechanism 453 locks the erasing device 402 and the third casing 14.

To lock means to connect the first sheet stack 403 and the erasing device 402 to thereby restrict slide of the first sheet stack 403 and the erasing device 402 in the Z-axis direction.

Further, to lock means to connect the second sheet stack 404 and the erasing device 402 to thereby restrict slide of the second sheet stack 404 and the erasing device 402 in the Z-axis direction.

Further, to lock means to connect the erasing device 402 and the third casing 14 to thereby restrict slide of the erasing device 402 in the Z-axis direction.

The first locking mechanism 451 is provided on the first sheet stack 403 (described later).

The second locking mechanism 452 is provided on the second sheet stack 404 (described later).

The third locking mechanism 453 is provided on the erasing device 402 (described later).

The first locking mechanism 451, the second locking mechanism 452, and the third locking mechanism 453 have the same structure.

Each of the first to third locking mechanisms 451-453 includes the movable rod 461, the receiving slot 462, the spring member 463, and the pair of brackets 465, 466.

The receiving slot 462 of the first or second locking mechanism 451, 452 is provided through the side surface of the exterior cover 423 of the erasing device 402. The movable rod 461 of the first or second locking mechanism 451, 452 is inserted to the receiving slot 462 to lock.

The receiving slot 462 of the third locking mechanism 453 is provided through the frame 14*a* of the third casing 14. The movable rod 461 of the third locking mechanism 453 is inserted to lock.

The brackets 465, 466 of the first locking mechanism 451 are provided on the back surface of the exterior cover 421 of the first sheet stack 403 fixedly.

The brackets 465, 466 of the second locking mechanism 452 are provided on the back surface of the exterior cover 422 of the second sheet stack 404 fixedly.

The brackets 465, 466 of the third locking mechanism 453 are provided on the back surface of the exterior cover 423 of the erasing device 402 fixedly.

The bracket 465, 466 has a hole (not shown) through which the movable rod 461 is inserted.

The bracket 465, 466 supports the movable rod 461, which is inserted in the hole, in order that the movable rod 461 may be movable in the X-axis direction and may be inserted in the receiving slot 462.

The bracket 465 supports an end of the movable rod 461, which is opposite to the front end 461*a* (end that is inserted in the receiving slot 462) of the movable rod 461.

The bracket 466 supports a middle part of the movable rod 461, the distance between the bracket 466 and the front end 461*a* being smaller than the distance between the bracket 465 and the front end 461*a*.

The movable rod 461 of each of the first to third locking mechanisms 451-453 includes the front end 461*a* and the spring receiving member 461*b*.

The front end 461*a* of the movable rod 461 of the first or second locking mechanism 451, 452 has an inclination, which is inclined to the front surface side of the third casing 14 in the movement direction of the first or second sheet stack 403, 404 getting out of the third casing 14.

The front end 461*a* of the movable rod 461 of the third locking mechanism 453 has an inclination, which is inclined to the back surface side of the third casing 14 in the movement direction of the erasing device 402 getting out of the third casing 14.

The spring receiving member 461*b* is fixedly provided near the middle part of the movable rod 461.

The spring receiving member 461*b* is between the bracket 465 and the bracket 466, where the brackets 465, 466 support the movable rod 461.

The spring member 463 of each of the first to third locking mechanisms 451-453 is between the spring receiving member 461*b* and the bracket 465, and biases the movable rod 461 toward the receiving slot 462 side via the spring receiving member 461*b*.

Note that the structure of the locking mechanism is not limited to the above.

According to the structure of the first locking mechanism, the movable rod 461 is inserted in the receiving slot 462 of the erasing device 402, and the erasing device 402 and the first sheet stack 403 are thereby locked.

According to the structure of the second locking mechanism, the movable rod 461 is inserted in the receiving slot 462 of the erasing device 402, and the erasing device 402 and the second sheet stack 404 are thereby locked.

According to the structure of the third locking mechanism, the movable rod 461 is inserted in the receiving slot 462 of the frame 14*a* of the third casing 14, and the erasing device 402 and the third casing 14 are thereby locked.

The spring member 463 biases the movable rod 461 toward the receiving slot 462 side, and the locked status is thereby maintained.

When the movable rod 461 is moved in the direction opposite to the receiving slot 462 against the spring force of the spring member 463, then the locked status is released (unlocked).

In this embodiment, as described above, the receiving slots 462 of the first and second locking mechanisms 451, 452 are provided through the side surface of the exterior cover 423 of the erasing device 402. The receiving slot 462 of the third locking mechanism 453 is provided through the frame 14*a* of the third casing 14.

Further, the front end 461*a* of the movable rod 461 inserted in the receiving slot 462 has an inclination, which is inclined as described above.

So, for example, when a user places the erasing device 402 in the third casing 14, where the first sheet stack 403 and the second sheet stack 404 are placed in the third casing of the erasing unit 400, the exterior cover 423 of the erasing device 402 is moved in the direction opposite to the movement direction of the erasing device 402 getting out of the third casing 14, the exterior cover 423 being in close contact with the inclinations of the front ends 461*a* of the movable rods 461 of the first and second locking mechanisms 451, 452.

Further, when the movable rods 461 are in close contact with the side surface of the exterior cover 423, then the movable rods 461 are moved in the unlocking direction against the spring force of the spring member 463.

Further, when the exterior cover 423 is moved, then the receiving slots 462 of the side surface of the exterior cover 423 are moved to the positions of the movable rods 461 of the first and second locking mechanisms 451, 452. Then the movable rods 461 are inserted in the receiving slots 462 of the exterior cover 423 thanks to the spring forces of the spring members 463.

Meanwhile, the movable rod 461 of the third locking mechanism 453 is moved in the direction opposite to the movement direction of the erasing device 402 getting out of the third casing 14 together with the movement of the exterior cover 423, the front end 461*a* of the movable rod 461 of the third locking mechanism 453 being in close contact with the frame 14*a* of the third casing 14.

Further, the movable rod 461 of the third locking mechanism 453 is moved in the unlocking direction against the spring force of the spring member 463, the movable rod 461 of the third locking mechanism 453 being in close contact with the frame 14*a* of the third casing 14.

Further, when the exterior cover 423 is moved as described above, the movable rod 461 of the third locking mechanism 453 is moved to the position of the receiving slot 462 of the frame 14*a*. Then the movable rod 461 of the third locking mechanism 453 is also inserted into the receiving slot 462 of the frame 14*a* thanks to the spring force of the spring member 463.

As described above, the movable rod 461 of the first or second locking mechanism 451, 452 is arranged at the back surface side of the exterior cover 421, 422 of the first or second sheet stack 403, 404 with the brackets 465, 466.

Further, the movable rod 461 of the third locking mechanism 453 is arranged at the back surface side of the exterior cover 423 of the erasing device 402 with the brackets 465, 466.

Further, the exterior cover 421, 422, 423 includes an unlocking mechanism to unlock.

The unlocking mechanism includes the unlocking knob 421*a*, 422*a*, 423*a*, and the link mechanism 464 for the unlocking knob 421*a*, 422*a*, 423*a*.

As shown in FIG. 12, the unlocking knob 421*a*, 422*a*, 423*a* is arranged on the front surface of the exterior cover 421, 422, 423.

The unlocking knobs 421*a*, 422*a*, 423*a* are rotatable knobs, which are operated by a user to unlock.

The link mechanism 464 is a mechanism that connects the unlocking knob 421*a*, 422*a*, 423*a* with the movable rod 461.

In other words, the unlocking knob 421*a*, 422*a*, 423*a* is connected with the movable rod 461 by the link mechanism 464.

The link mechanism 464 converts the rotary movement of the unlocking knob 421*a*, 422*a*, 423*a* into the linear movement in the X-axis direction, and causes the movable rod 461 to move in the movement direction getting out of the receiving slot 462 when unlocking.

FIG. 12 shows that the first sheet stack 403, the second sheet stack 404, and the erasing device 402 are inside of the third casing 14 (hereinafter referred to as fully-closed status).

Further, in the fully-closed status, the locked statuses of the first locking mechanism 451, the second locking mechanism 452, and the third locking mechanism 453 are maintained.

Figure 13:
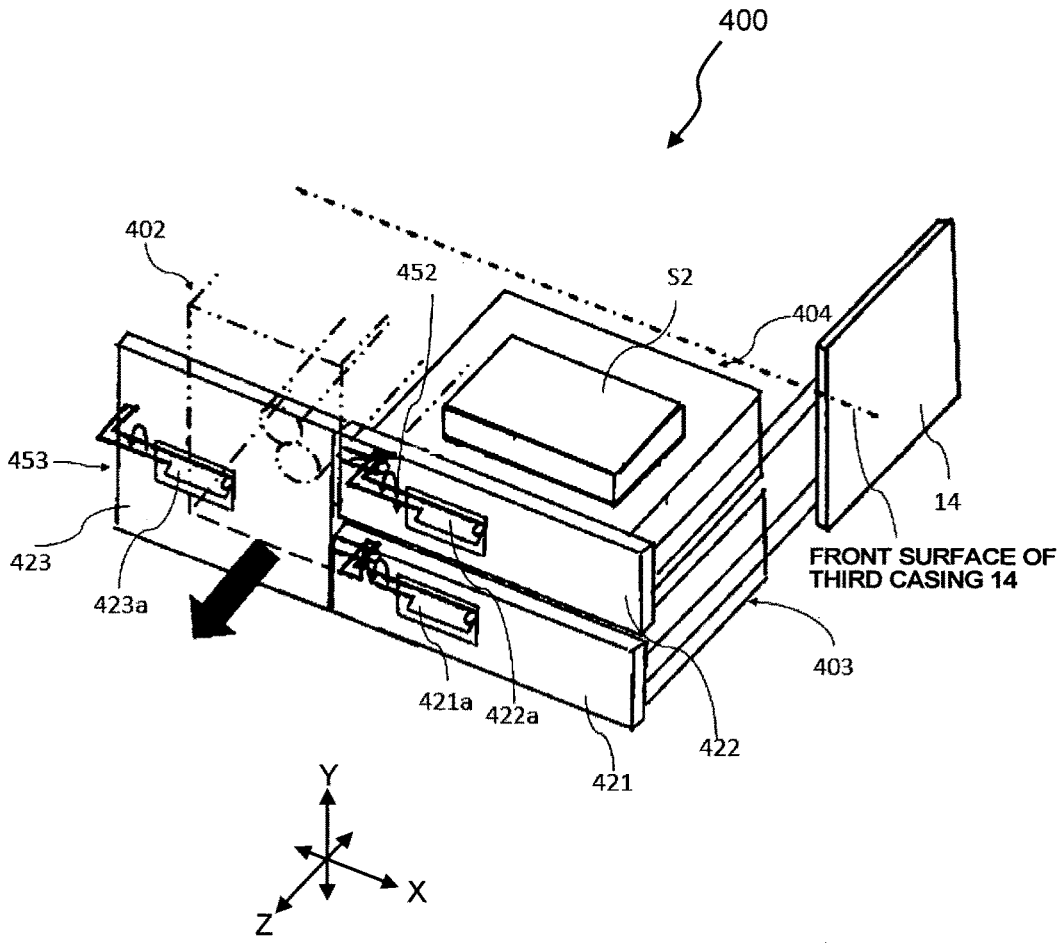
FIG. 13 is a perspective view showing that the first and second sheet stacks and the erasing device are moved out of the third casing of the erasing unit of FIG. 12 in a unified manner.

As shown in FIG. 13, in the fully-closed status, when a user grasps the unlocking knob 423*a* of the third locking mechanism 453 of the erasing device 402, the third locking mechanism 453 is unlocked.

In other words, in relation to the third casing 14, only the erasing device 402 is locked.

In relation to the erasing device 402, the first sheet stack 403 and the second sheet stack 404 are locked only with the first locking mechanism 451 and the second locking mechanism 452.

So, after the third locking mechanism 453 is unlocked, then a user is capable of removing the erasing device 402, the first sheet stack 403, and the second sheet stack 404, in a unified manner, out of the front surface side of the third casing 14.

As a result, the user is capable of opening the space above the erasing device 402 and the second sheet stack 404.

Figure 14:
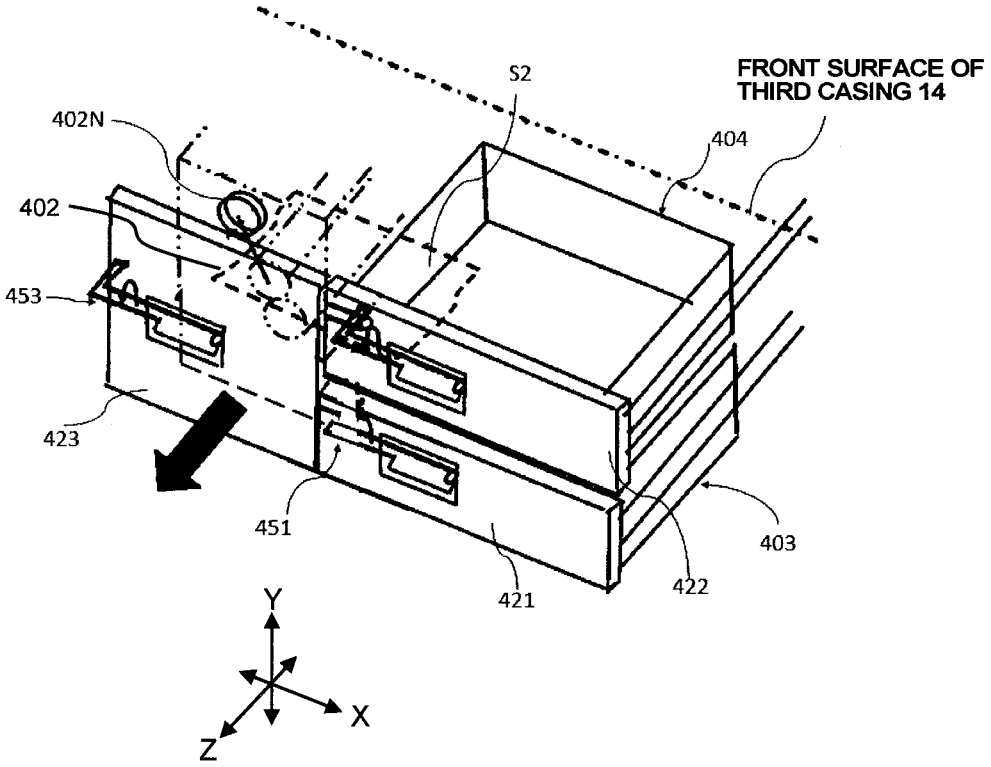
FIG. 14 is a perspective view illustrating how to clear a paper jam of the erasing unit of FIG. 13.

So, as shown in FIG. 14, for example, when the sheet S2 is jammed between the erasing device 402 and the second sheet stack 404, a user is capable of directly looking at the jammed sheet S2 between the erasing device 402 and the second sheet stack 404.

Here, the erasing device 402 includes the roller-rotary knob 402N.

The roller-rotary knob 402N is at the front surface side of the erasing device 402 and is visible.

The roller-rotary knob 402N is capable being rotated by a user.

When a user rotates the roller-rotary knob 402N, then the heat rollers 402R are rotated.

So, when a user rotates the roller-rotary knob 402N in a predetermined direction manually, then the heat rollers 402R of the erasing device 402 are rotated, and the jammed sheet S2 is discharged to the second sheet stack 404 side. The user may remove the discharged sheet S2 out of the erasing unit 400 to thereby clear the paper jam.

After clearing the paper jam, the user places the first sheet stack 403, the second sheet stack 404, and the erasing device 402 in the third casing 14.

At this time, because the total weight of the first sheet stack 403, the second sheet stack 404, and the erasing device 402 is large, for example, the user firstly unlocks the second locking mechanism 452, and places the second sheet stack 404 in the third casing 14. Next, the user unlocks the first locking mechanism 451, and places the first sheet stack 403 in the third casing 14. Finally, the user places the erasing device 402 in the third casing 14.

Further, for example, when a paper jam is occurred between the erasing device 402 and the first sheet stack 403, a user unlocks the second locking mechanism 452, and places the second sheet stack 404 in the third casing 14. As a result, the space above the first sheet stack 403 may be opened.

As a result, the user may remove the jammed sheet S1.

After the paper jam is cleared, the user may unlock the first lock mechanism 451, firstly place the first sheet stack 403 in the third casing 14, and then place the erasing device 402 in the third casing 14. Alternatively, the user may place the first sheet stack 403 and the erasing device 402, in a unified manner, in the third casing 14 without unlocking the first locking mechanism 451.

According to the above-mentioned embodiments, for example, the following effects may be attained.

(1) According to the above-mentioned embodiments, the erasing unit 400 is stored in the third casing 14, the third casing 14 being capable of being connected with the second casing 12 of the first feeder unit 200 of the image forming apparatus 1.

So the erasing unit 400 may be used as not only an individual erasing unit but also an optional unit, which is connected with the image forming apparatus 1 to add the erasing function to the image forming apparatus 1 having other functions.

(2) According to the above-mentioned embodiments, the erasing unit 400 functions as not only an erasing unit but also a feeder unit. So not only the erasing function but also the feeding function may be added to the image forming apparatus, with which the erasing unit 400 is connected.

(3) According to the third embodiment of FIG. 7, the first sheet stack 403, the second sheet stack 404, and the erasing device 402 of the erasing unit 400 are capable of getting out of and entering in the third casing 14 individually and independently.

So, for example, even if a user removes the first sheet stack 403 or the second sheet stack 404 out of the third casing 14, the erasing device 402 of the erasing unit 400 is still inside of the third casing 14.

So, even if the user removes the first sheet stack 403 or the second sheet stack 404 out of the third casing 14, the heating temperature of the erasing device 402 will hardly drop.

Because of this, even if the user places the first sheet stack 403 or the second sheet stack 404 in the third casing 14 and the erasing processing is performed immediately after that, it takes a shorter wait time for the user until the temperature of the erasing device 402 rises to a predetermined erasing temperature.

(4) According to the erasing unit 400 of the seventh embodiment, to remove the erasing device 402 individually out of the third casing 14 by a user is restricted.

Further, the erasing device 402 is capable of getting out of the third casing 14 only when the first sheet stack 403, the second sheet stack 404, and the erasing device 402 are out of the third casing 14 in a unified manner.

In general, for example, the temperature of a portion for operating a heat source (e.g., the roller-rotary knob 402N for the heat rollers 402R of the erasing unit 400) is likely to be high. So it is not desirable for a user to touch such portion and the vicinity thereof with his hands.

To the contrary, according to the erasing unit 400 of the seventh embodiment, even if the erasing device 402 is out of the third casing 14, a user hardly touches the heat rollers 402R, i.e., the heat source of the erasing device 402, with his hands.

In other words, according to the erasing unit 400 of this embodiment, because the first sheet stack 403, the second sheet stack 404, and the erasing device 402 get out of the third casing 14 in a unified manner, it is possible to prevent the heat source of the erasing unit 400 from being touched carelessly by a user with his hands.

(5) According to the erasing unit 400 of the first embodiment, the first and second sheet stacks 403, 404 are capable of getting out of the third casing 14 individually, where the erasing device 402 is inside of the third casing 14.

So, a user is capable of removing the first and second sheet stacks 403, 404 out of the third casing 14 with a small force without removing the heavy erasing device 402, which includes the heat rollers 402R and the like, out of the third casing 14.

According to the above-mentioned embodiments, the length of the part of the first sheet stack 403, which is capable of getting out of the front surface of the third casing 14, is larger than the length of the erasing device 402 in the front-back direction (Z-axis direction) in order to place the unerased sheets S1 in the first sheet stack 403 easily, for example.

Further, the length of the part of the first sheet stack 403, which is capable of getting out of the front surface of the third casing 14, is equal to or larger than the length of part of the erasing device 402, which is capable of getting out of the front surface of the third casing 14, in order to clear a paper jam easily.

Note that, according to the above-mentioned embodiments, the erasing unit 400 erases images on sheets with heat. However, the erasing method of the erasing unit 400 is not limited to the erasing method with heat. For example, the erasing unit 400 may be an apparatus that erases images on sheets with irradiation with light, or an apparatus that erases images on special sheets. Alternatively, the erasing unit 400 may be an apparatus that removes (erases) images from sheets. The erasing unit 400 may be an apparatus capable of making images on sheets unrecognizable visually, in order to reuse sheets.

Eighth Embodiment

Hereinafter, the eighth embodiment will be described with reference to FIG. 15 to FIG. 18.

Note that, in the following description of the eighth embodiment, the part the same as or similar to that of the above-mentioned first to seventh embodiments will be denoted by the same reference symbols, and detailed description thereof will be omitted.

Figure 15:
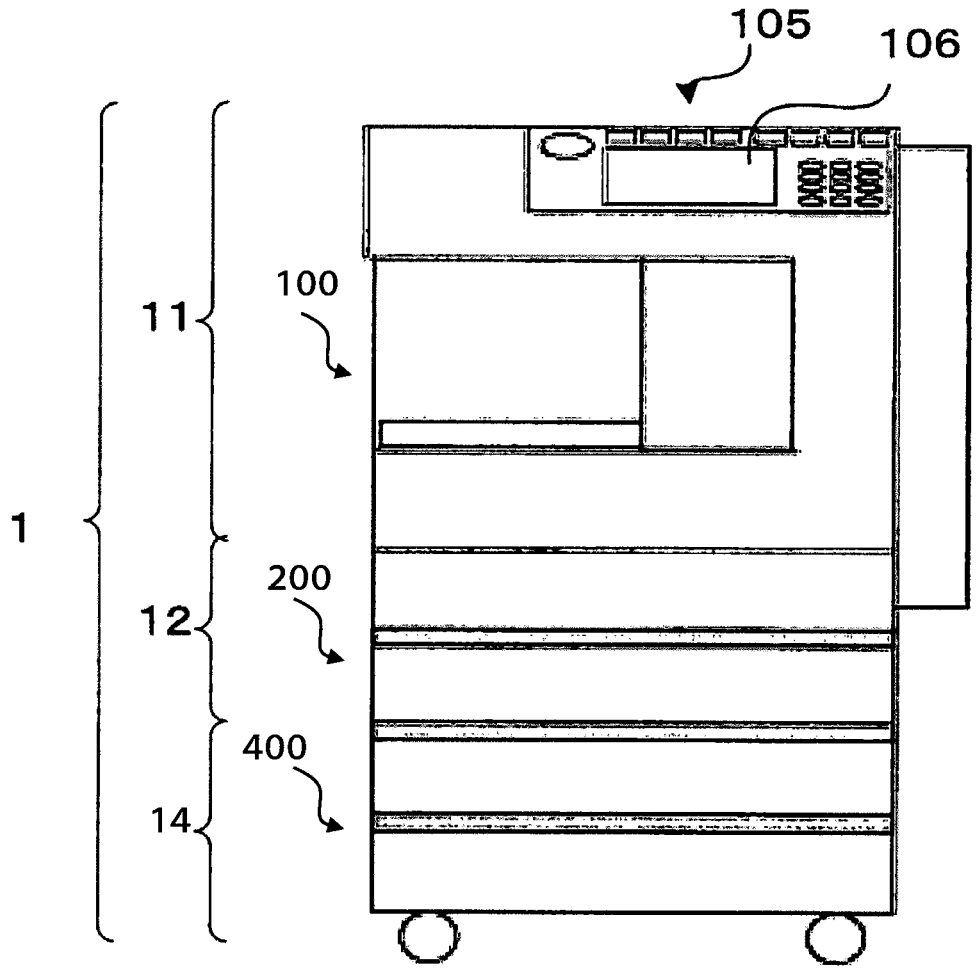
FIG. 15 is a front appearance diagram showing the image forming apparatus of the eighth embodiment.

FIG. 15 is a front appearance diagram of the image forming apparatus of this embodiment.

Figure 16:
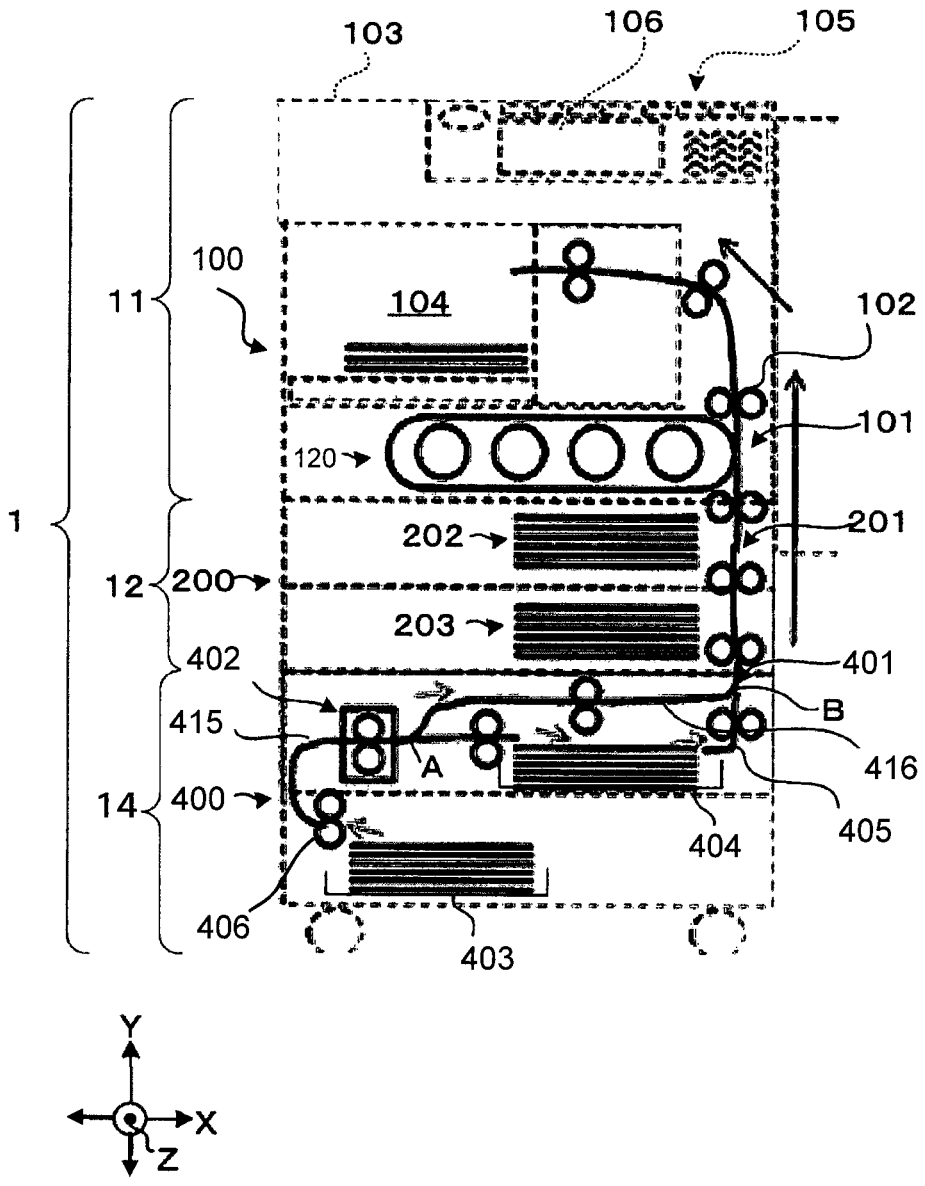
FIG. 16 is a front sectional view schematically showing the image forming apparatus of FIG. 15.

FIG. 16 is a front sectional view of the image forming apparatus of FIG. 15.

Figure 17:
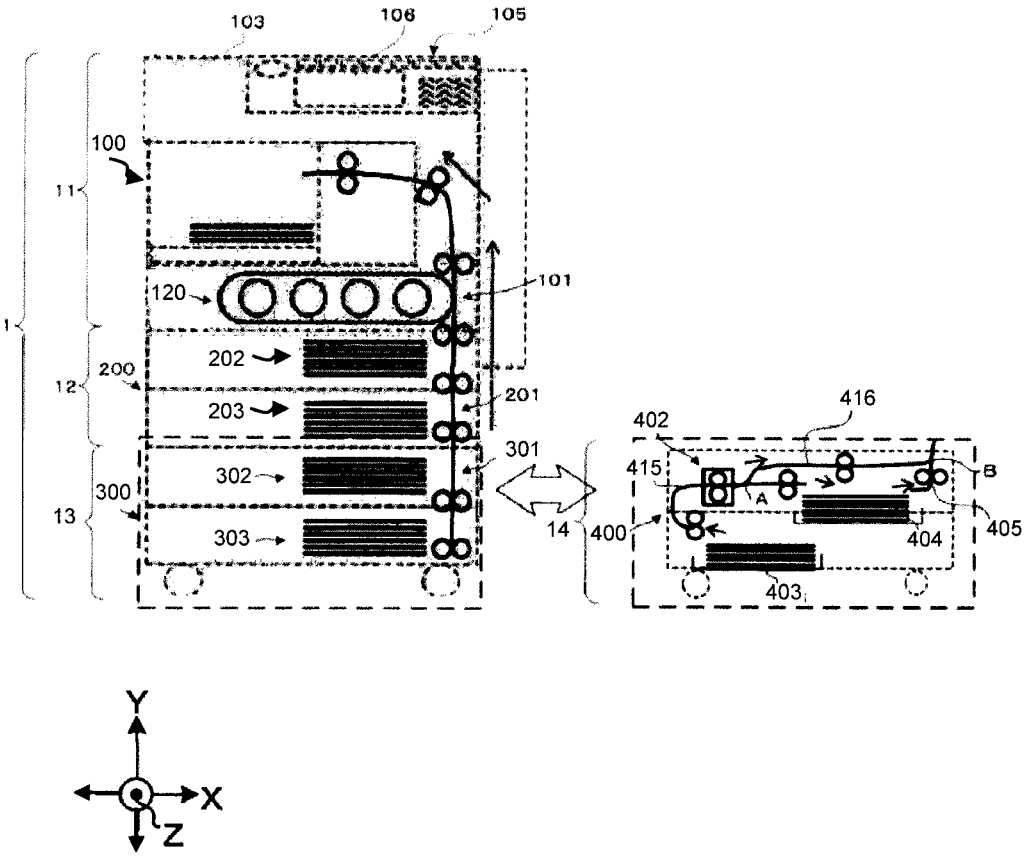
FIG. 17 is a diagram showing that the second feeder unit is exchangeable for the erasing unit in the image forming apparatus of FIG. 16.

FIG. 17 is a diagram showing that the second feeder unit of the image forming apparatus of FIG. 15 is exchangeable for the erasing unit.

Similar to the image forming apparatus of the first embodiment, the image forming apparatus 1 of this embodiment includes the image forming apparatus main body 100, the first feeder unit 200, the second feeder unit 300, and the erasing unit 400. The image forming apparatus main body 100 includes the first casing 11.

The first feeder unit 200 includes the second casing 12.

The erasing unit 400 includes the third casing 14.

The second feeder unit 300 includes the fourth casing 13.

The first to fourth casings 11-14 have individual and independent structures.

For example, as shown in FIG. 15, the first casing 11 is fixedly attached to the second casing 12 top-to-bottom.

For example, as shown in FIG. 15 or FIG. 16, the third casing 14 is connectably and detachably attached to the lower portion of the second casing 12.

For example, as shown in FIG. 17, the fourth casing 13 is connectably and detachably attached to the lower portion of the second casing 12 in place of the third casing 14.

In other words, the third and fourth casings 13, 14 are attached to the lower portion of the second casing 12 exchangeable.

The image forming apparatus main body 100 includes, in the first casing 11, the printer device 120 and the fusing device 102 as devices for the image formation process.

Further, the image forming apparatus main body 100 includes, in the first casing 11, the scanner device 103, the discharging device 104, the operation/display device 105, and the like.

The operation/display device 105 includes the display unit 106 and the display controller 110.

Figure 18:
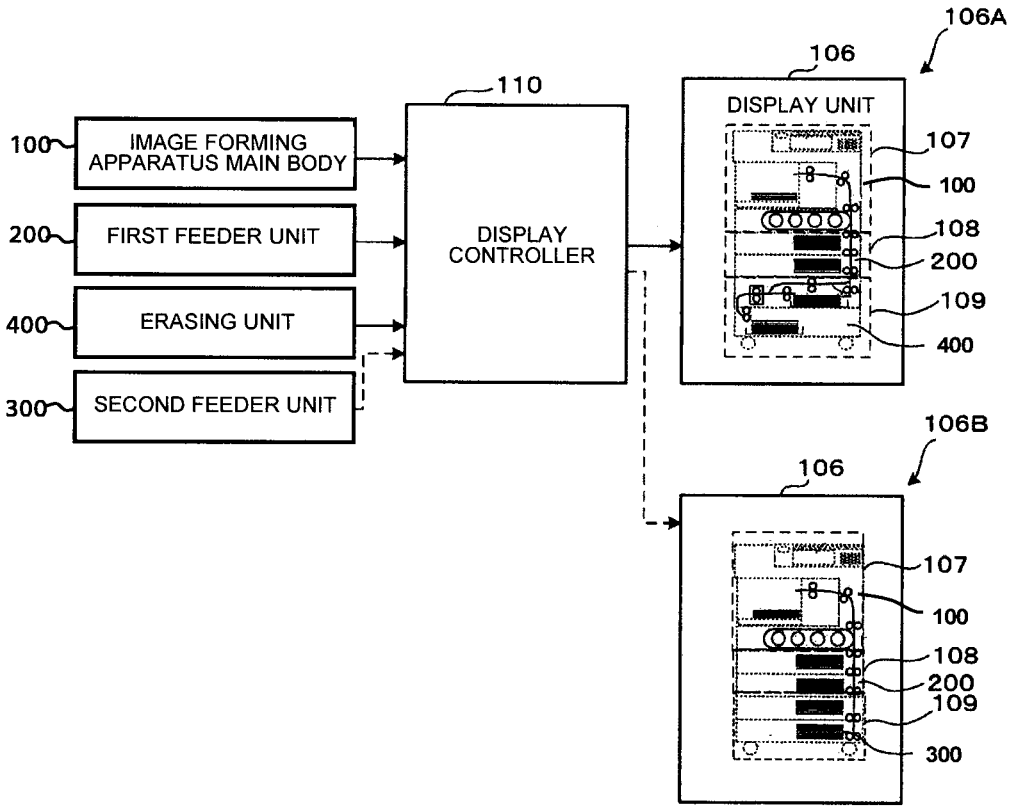
FIG. 18 is a block diagram showing the display unit of the image forming apparatus of FIG. 16.

As shown in FIG. 18, the display unit 106 includes the first display area 107, the second display area 108, and the third display area 109.

The display unit 106 displays the functions of the image forming apparatus main body 100 in the first display area 107 with texts, graphics, and the like.

The display unit 106 displays the functions of the first feeder unit 200 in the second display area 108 with texts, graphics, and the like.

The display unit 106 displays the functions of the second feeder unit 300 or the erasing unit 400 in the third display area 109 with texts, graphics, and the like.

According to the image forming apparatus 1 of this embodiment, the second casing 12 of the first feeder unit 200 is connected to the first casing 11 of the image forming apparatus main body 100. In addition, the third casing 14 of the erasing unit 400 or the fourth casing 13 of the second feeder unit 300 is connected to the first casing 11 of the image forming apparatus main body 100, the second casing 12 being interposed therebetween.

In other words, the image forming apparatus 1 includes three structural units at most depending on the connection combination of the above-mentioned structural units 200-400 and the image forming apparatus main body 100.

In view of this, the display unit 106 has the three display areas (first to third display areas 107-109) in order to display the connection combinations of the structural units 200-400 and the image forming apparatus main body 100.

Note that, according to the combination of FIG. 16, the lower portion of the first casing 11 of the image forming apparatus main body 100, the second casing 12, which stores the first feeder unit 200, and the third casing 14, which stores the erasing unit 400, are connected top-to-bottom.

In the combination of FIG. 16, as shown in FIG. 18, the display unit 106 displays graphics of the image forming apparatus main body 100 in the first display area 107, graphics of the first feeder unit 200 in the second display area 108, and graphics of the erasing unit 400 in the third display area 109. This is the first display mode 106A.

Further, according to the combination of FIG. 17, to the lower portion of the first casing 11 of the image forming apparatus main body 100, the second casing 12, which stores the first feeder unit 200, and the fourth casing 13, which stores the second feeder unit 300, in place of the third casing 14 of the erasing unit 400, are connected top-to-bottom.

In the combination of FIG. 17, as shown in FIG. 18, the display unit 106 displays graphics of the image forming apparatus main body 100 in the first display area 107, graphics of the first feeder unit 200 in the second display area 108, and graphics of the second feeder unit 300 in the third display area 109. This is the second display mode 106B.

As described above, the image forming apparatus 1 displays the structural units 200-400, which are currently-connected to the image forming apparatus main body 100, on the display unit 106, and thereby user-friendliness may be increased.

Note that the display of the display unit 106 is not necessarily be graphics display. According to another display mode, text information may be displayed.

The first feeder unit 200, the second feeder unit 300, or the erasing unit 400 includes a ROM that records function information and connection position information of each unit. For example, the ROM of the first or second feeder unit 200, 300 records, as function information, information on the feeding function of the unit. The ROM of the first feeder unit 200 records, as connection position information, information on the lower portion of the image forming apparatus main body 100, to which the unit is connected. The ROM of the second feeder unit 300 records, as connection position information, information on the lower portion of the first feeder unit 200, to which the unit is connected. The ROM of the erasing unit 400 records, as function information, information on the erasing function and feeding the function of the unit. The ROM of the erasing unit 400 further records, as connection position information, information on the lower portion of the first feeder unit 200, to which the unit is connected.

The feeding function of the first and second feeder units 200, 300 is a function of supplying unused sheets. The feeding function of the erasing unit 400 is a function of supplying the erased sheets S2 (reusable sheets).

The casings 12-14 accommodate the ROMs of the units 200-400.

As shown in FIG. 18, the display controller 110 reads the information recorded in the ROMs of the units 200-400.

The display controller 110 determines, based on the results of the read information, if the display unit 106 displays the first display mode 106A or the second display mode 106B.

For example, as shown in FIG. 17, the second feeder unit 300 is connected to the lower portion of the first feeder unit 200 in place of the erasing unit 400. In this case, the display controller 110 reads the function information and the connection position information recorded in the ROM of the second feeder unit 300.

The display controller 110 determines, based on the results of the read information, that the display unit 106 displays the second display mode 106B. The display controller 110 controls the display unit 106 based on the determined result. As described above, according to the second display mode 106B, the display unit 106 displays graphics of the image forming apparatus main body 100 in the first display area 107, graphics of the first feeder unit 200 in the second display area 108, and graphics of the second feeder unit 300 in the third display area 109.

Note that, as described above, the display controller 110 displays the functions of the image forming apparatus main body 100 on the display unit 106 in both the first display mode 106A and the second display mode 106B.

According to this embodiment, as shown in FIG. 16 and FIG. 17, the image forming apparatus main body 100, the first feeder unit 200, the second feeder unit 300, and the erasing unit 400 include the first conveying path 101, the second conveying path 201, the third conveying path 401, and the fourth conveying path 301.

According to this embodiment, the first conveying path 101 is a conveying path from the bottom portion of the first casing 11 of the image forming apparatus main body 100 to the discharging device 104 of FIG. 16 and FIG. 17.

The structures of the first to fourth conveying paths 101-401 are the same as those of the above mentioned first to fourth conveying paths of the first embodiment. So detailed description thereof will be omitted.

Similar to the first embodiment, the first feeder unit 200 includes a paper cassette as a sheet-storage unit. Specifically, for example, as shown in FIG. 16, the first feeder unit 200 includes the first paper cassette 202 and the second paper cassette 203. The double-deck first and second paper cassettes 202, 203 are arranged in the second casing 12 in the Y-axis direction top-to-bottom.

The first and second paper cassettes 202, 203 store unused sheets, e.g., A4-size sheets and A5-size sheets.

According to this embodiment, similar to the first feeder unit 200, the second feeder unit 300 includes two paper cassettes as sheet-storage units. Specifically, for example, as shown in FIG. 17, the second feeder unit 300 includes the first paper cassette 302 and the second paper cassette 303. The double-deck first and second paper cassettes 302, 303 are arranged in the fourth casing 13 in the Y-axis direction top-to-bottom.

The first and second paper cassettes 302, 303 may store, for example, the erased sheets S2 (reusable sheets), e.g., A4-size reusable sheets and A5-size reusable sheets, or may store unused sheets.

The second feeder unit 300 removes a sheet from one of the first and second paper cassettes 302, 303 by using feed rollers (not shown), and supplies the removed sheet to the fourth conveying path 301. Similar to the first embodiment, a toner image is transferred to the sheet supplied to the fourth conveying path 301, the transferred toner image is fused, and thereafter the sheet is discharged to the discharging device 104.

Similar to the first embodiment, the second feeder unit 300 is connectably attached to the first feeder unit 200 in place of the erasing unit 400.

For example, as shown in FIG. 16, if the first feeder unit 200 is connected to the erasing unit 400, a user releases connection between the second casing 12 of the first feeder unit 200 and the third casing 14 of the erasing unit 400 with a connecting mechanism (not shown). After releasing the connection, the user lifts up the first casing 11 of the image forming apparatus main body 100 and the second casing 12 of the first feeder unit 200 to thereby remove the third casing 14 of the erasing unit 400 from the second casing 12 of the first feeder unit 200. Further, the user places the second casing 12 of the first feeder unit 200 on the fourth casing 13 of the second feeder unit 300, and places the first casing 11 of the image forming apparatus main body 100 on the second casing 12 of the first feeder unit 200. After placing the second casing 12 on the fourth casing 13 and the first casing on the second casing 12, the user connects the fourth casing 13 with the second casing 12 by using a connecting mechanism (not shown).

As shown in FIG. 17, if the second feeder unit 300 is connected as described above, then the image forming apparatus 1 includes four paper cassettes.

As shown in FIG. 17, the first feeder unit 200 is connected with the first feeder unit 300. In place of the second feeder unit 300, the erasing unit 400 is further connected to the first feeder unit 200, and the image forming apparatus 1 thereby has an erasing function.

Similar to the first embodiment, the erasing unit 400 includes the third conveying path 401, the erasing device 402, the first sheet stack 403, the second sheet stack 404, and the discharge conveying path 405.

Further, according to this embodiment, the erasing unit 400 includes the main sheet conveying path 415, the bypass sheet conveying path 416, and a conveying path selector (not shown). Further, the erasing unit 400 includes motors that drive the structural elements, and includes other components.

The erasing device 402 has, for example, the structure similar to that of the erasing device of the first embodiment. The erasing device 402 thus heats images formed with erasable color materials (for example, toner or ink) at the erasing temperature or more to erase the images.

Similar to the first sheet stack of the first embodiment, the first sheet stack 403 stores the unerased sheets S1.

Similar to the first sheet stack of the second embodiment, the second sheet stack 404 stores the erased sheet S2.

The second sheet stack 404 is arranged at the third conveying path 401 side in the third casing 14 (right end of FIG. 16).

Meanwhile, the first sheet stack 403 and the erasing device 402 are arranged at the side opposite to the third conveying path 401 side in the direction opposite to the feeding direction, in which sheets are supplied from the second sheet stack 404 to the third conveying path 401 (left end of FIG. 16).

Further, as shown in FIG. 16, the first sheet stack 403 is arranged at the lower portion of the third casing 14.

The second sheet stack 404 and the erasing device 402 are arranged at the upper portion of the third casing 14.

Note that the top-to-bottom relation of the second sheet stack 404 and the first sheet stack 403 of FIG. 16 may be upside down.

The main sheet conveying path 415 is between the first sheet stack 403 and the second sheet stack 404.

The erasing device 402 is at the downstream of the first sheet stack 403 in the sheet conveying direction of the main sheet conveying path 415, and is at the upstream of the second sheet stack 404 in the sheet conveying direction.

The main sheet conveying path 415 conveys the unerased sheets S1 stored in the first sheet stack 403 to the erasing device 402, and further conveys the unerased sheets S1 to the second sheet stack 404.

As shown in FIG. 16, the bypass sheet conveying path 416 is between the branch point A of the erasing device 402 and the second sheet stack 404, and the meeting point B with the third conveying path 401.

The conveying path selector is at the branch point A.

If the conveying path selector is turned off, the main sheet conveying path 415 is opened, and the erased sheets S2 are guided to the second sheet stack 404.

Meanwhile, if the conveying path selector is turned on, the main sheet conveying path 415 is closed, and the erased sheets S2 are guided to the bypass sheet conveying path 416.

The bypass sheet conveying path 416 supplies the erased sheets S2 guided by the conveying path selector to the third conveying path 401.

So, if the bypass sheet conveying path 416 conveys the erased sheets, the erasing unit 400 is capable of directly conveying the erased sheets S2 erased by the erasing device 402 to the printer device 120 via the third conveying path 401.

The discharge conveying path 405 supplies the erased sheets stored in the second sheet stack 404 to the third conveying path 401.

Similar to the first embodiment, the third casing 14 slidably supports the first sheet stack 403 movably into and out of the front surface side of the third casing 14. So a user is capable of pulling out of the first sheet stack 403 from the third casing 14 in order to place the unerased sheets S1 in the first sheet stack 403.

Further, similar to the first embodiment, the third casing 14 also slidably supports the second sheet stack 404 movably into and out of the front surface side of the third casing 14.

So a user is capable of removing the second sheet stack 404 out of the third casing 14 in order to clear a paper jam.

The erasing unit 400 in the third casing 14 erases the unerased sheets S1 by using the erasing device 402. The erasing unit 400 temporarily stores the erased sheets S2 in the second sheet stack 404.

For example, as shown in FIG. 16, if the erasing unit 400 is connected with the first feeder unit 200, when the first paper cassette 202 and the second paper cassette 203 in the second casing 12 of the first feeder unit 200 store no more sheets, the erasing unit 400 supplies the erased sheets S2 stored in the second sheet stack 404 to the third conveying path 401 via the discharge conveying path 405.

So even if the first and second paper cassettes 202, 203 of the first feeder unit 200 store no more sheets, the image forming apparatus 1 is capable of forming images on the erased sheets S2 supplied from the erasing unit 400.

In other words, the second sheet stack 404 of the erasing unit 400 has a buffering function of temporarily or accumulating the erased sheets S2 for the first feeder unit 200.

Further, according to this embodiment, the erasing device 402 of the erasing unit 400 is at the left end of the third casing 14 in the X-axis direction (for example, see FIG. 16).

Similar to the first embodiment, the erasing device 402 includes a pair of heat rollers. For example, in FIG. 16, the heat rollers are arranged one above the other, and are pressurized in contact with each other. The heat rollers of the erasing device 402 allow the unerased sheets S1 to pass therethrough at the portions pressurized in contact with each other.

Further, similar to the first embodiment, the double-deck second sheet stack 404 and first sheet stack 403 are arranged separately in the third casing 14 top-to-bottom in the Y-axis direction.

The erasing unit 400 conveys the unerased sheets S1 stored in the first sheet stack 403 to the erasing device 402 via the main sheet conveying path 415, and thereby erase images.

For example, if the second sheet stack 404 stores no more erased sheets S2, the erasing unit 400 may convey the unerased sheets S1 stored in the first sheet stack 403 to the erasing device 402, and erase images.

Further, if the conveying path selector is turned on, the erasing unit 400 is capable of supplying the erased sheets S2 to the third conveying path 401 via the bypass sheet conveying path 416. The erasing unit 400 is capable of supplying the erased sheets S2 to the third conveying path 401 via the bypass sheet conveying path 416, different from supplying the erased sheets S2 stored in the second sheet stack 404.

Note that the main sheet conveying path 415 of the erasing unit 400 is a sheet conveying path from the first sheet stack 403 to the second sheet stack 404. The bypass sheet conveying path 416 is a sheet conveying path from the branch point A to the meeting point B, the bypass sheet conveying path 416 being branched from the main sheet conveying path 415 at the branch point A. However, the sheet conveying paths of the erasing unit 400 are not limited to those of this example. For example, a main sheet conveying path may be a sheet conveying path from the branch point A to the meeting point B, and a bypass sheet conveying path may be a sheet conveying path from the branch point A to the second sheet stack 404.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An erasing apparatus that erases an image formed on a sheet, comprising:

a first sheet stack configured to store an unerased sheet;

an erasing device configured to erase an image from an unerased sheet, the unerased sheet being supplied from the first sheet stack to the erasing device in a first direction; and a casing that slidably supports the first sheet stack and the erasing device, the first sheet stack and the erasing device being linearly movable into and out of the casing in a second direction perpendicular to the first direction and parallel to a surface of the unerased sheet supplied from the first sheet stack.

2. The erasing apparatus according to claim 1, further comprising:

a second sheet stack configured to store an erased sheet on which an image has been erased by the erasing device, wherein the casing slidably supports the second sheet stack so that the second sheet stack is linearly movable into and out of the casing in the second direction and independently of the first sheet stack and the erasing device.

3. The erasing apparatus according to claim 2, further comprising:

a restricting member mounted on the first sheet stack, wherein the restricting member covers a side of the erasing device when the first sheet stack is positioned inside the casing, and wherein the restricting member causes the erasing device to be linearly movable out of the casing only after the first sheet stack is moved out of the casing.

4. The erasing apparatus according to claim 3, wherein
the restricting member is an exterior cover provided on a surface of the first sheet stack, and
the exterior cover extends to cover the side of the erasing device.

5. The erasing apparatus according to claim 1, wherein
the first sheet stack includes a first exterior cover provided on a surface thereof that is not visible until the first sheet stack is moved out of the casing,
the erasing device includes a second exterior cover provided on a surface thereof that is not visible until the erasing device is moved out of the casing, and
the first exterior cover and the second exterior cover are separate and individual exterior covers.

6. The erasing apparatus according to claim 1, further comprising:
a restricting member mounted on the first sheet stack and that restricts sliding movement of the first sheet stack and the erasing device out of and into the casing, wherein the restricting member:
restricts sliding movement of the first sheet stack and the erasing device so that the first sheet stack and the erasing device may be moved out of the casing in a unified manner, and
restricts sliding movement of the first sheet stack and the erasing device so that the first sheet stack and the erasing device may be moved into the casing independently.

7. The erasing apparatus according to claim 6, wherein
the restricting member includes:
a locking mechanism that restricts sliding movement of the first sheet stack and the erasing device so that the first sheet stack and the erasing device are prevented from being moved out of the casing, and
an unlocking mechanism that removes the sliding movement restriction of the locking mechanism.

8. The erasing apparatus according to claim 1, further comprising:
a conveying path in the casing for discharging an erased sheet having an image erased by the erasing device to the outside of the erasing apparatus, wherein
the conveying path is connected with a feeder of an image forming apparatus when the casing is connected with the image forming apparatus, and supplies the erased sheet to the image forming apparatus.

9. The erasing apparatus according to claim 1, wherein the erasing unit is entirely removable from the casing in the second direction.

10. An image forming apparatus, comprising:
an image forming apparatus main body;
a first feeder unit; and
an erasing unit, wherein
the image forming apparatus main body includes:
a printer device configured to form an image on a sheet,
a first casing in which the printer device is mounted, and
a first conveying path in the first casing, the first conveying path configured to convey the sheet to the printer device,
wherein the first feeder unit includes:
a storage unit configured to store sheets on which no image is formed,
a second casing in which the storage unit is mounted, the second casing being connected with the first casing, and
a second conveying path in the second casing, the second conveying path being connected with the first conveying path when the second casing is connected with the first casing, the second conveying path configured to supply the sheet to the first conveying path, and
the erasing unit includes
a first sheet stack configured to store an unerased sheet on which an image is formed,
an erasing device configured to erase the image formed on the unerased sheet,
a third casing slidably supporting the first sheet stack and the erasing device, the third casing being connected with the second casing, the first sheet stack and the erasing device being linearly moveable into and out of the third casing in a first direction parallel to a surface of the unerased sheet stored in the first sheet stack,
a third conveying path in the third casing, the third conveying path being connected with the second conveying path when the third casing is connected with the second casing, the third conveying path configured to supply an erased sheet on which an image is erased by the erasing device to the first conveying path via the second conveying path, and
a main sheet conveying path that
supplies the unerased sheet from the first sheet stack to the erasing device in a second direction perpendicular to the first direction and parallel to the surface of the unerased sheet supplied from the first sheet stack.

11. The image forming apparatus according to claim 10, wherein
the erasing unit further includes:
a second sheet stack configured to store the erased sheet, wherein the main sheet conveying path is further configured to convey the erased sheet from the erasing device to second sheet stack,
a discharge conveying path configured to discharge the erased sheet from the second sheet stack, and to supply the erased sheet to the third conveying path, and
a bypass conveying path configured to supply the erased sheet to the third conveying path not from the second sheet stack, the bypass conveying path being branched from the main sheet conveying path.

12. The image forming apparatus according to claim 11, wherein
the second sheet stack is at one end of the third casing in a supply direction, and the erasing device is at the other end of the third casing in the supply direction, the erased sheet being supplied to the second sheet stack in the supply direction of the third casing.

13. The image forming apparatus according to claim 10, wherein
the third casing is connectable to the second casing and detachable from the second casing, and
the third conveying path is configured to supply the erased sheet to the second conveying path when the third casing is connected with the second casing.

14. The image forming apparatus according to claim 13, further comprising:
a display unit configured to display information on the erasing unit when the third casing is connected with the second casing.

15. The erasing apparatus according to claim 10, wherein the entire erasing unit is entirely removable from the third casing in the second direction.

* * * * *